US010544765B2

(12) United States Patent
Choi et al.

(10) Patent No.: US 10,544,765 B2
(45) Date of Patent: Jan. 28, 2020

(54) CONNECTOR DEVICE

(71) Applicants: Hyundai Motor Company, Seoul (KR); Kia Motors Corporation, Seoul (KR); Sumitomo Wiring Systems, Ltd., Yokkaichi (JP)

(72) Inventors: Choo Saeng Choi, Seongnam-si (KR); Minho Lee, Seongnam-si (KR); Hideto Nakamura, Yokkaichi (KR)

(73) Assignees: Hyundai Motor Company, Seoul (KR); Kia Motors Corporation, Seoul (KR); Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 15/711,814

(22) Filed: Sep. 21, 2017

(65) Prior Publication Data

US 2018/0238279 A1 Aug. 23, 2018

(30) Foreign Application Priority Data

Feb. 21, 2017 (KR) ..... 10-2017-0022849

(51) Int. Cl.
*F02M 51/00* (2006.01)
*F02M 61/14* (2006.01)

(52) U.S. Cl.
CPC ..... *F02M 51/005* (2013.01); *F02M 61/14* (2013.01)

(58) Field of Classification Search
CPC . H01R 13/5829; H01R 13/514; F02M 51/005
USPC ..... 439/465, 467
See application file for complete search history.

(56) References Cited

U.S. PATENT DOCUMENTS 5,154,630 A * 10/1992 Kamono ..... H01R 13/4361 439/352
5,219,242 A * 6/1993 Liaw ..... H01R 13/516 403/24
5,586,916 A * 12/1996 Shinji ..... H01R 13/501 439/448
5,921,807 A * 7/1999 Okabe ..... H01R 13/514 439/467
6,478,609 B1 * 11/2002 Davis ..... H01R 13/5812 439/465
6,544,070 B1 * 4/2003 Radliff ..... H01R 4/2433 439/467
6,857,900 B2 * 2/2005 Kleeberger ..... H01R 13/6215 385/76
7,029,290 B2 * 4/2006 Wu ..... H01R 9/032 439/76.1

(Continued)

FOREIGN PATENT DOCUMENTS

JP 2015-034466 A 2/2015

*Primary Examiner* — Tulsidas C Patel
*Assistant Examiner* — Marcus E Harcum
(74) *Attorney, Agent, or Firm* — Morgan, Lewis & Bockius LLP

(57) ABSTRACT

A connector device with improved workability in fitting connectors may include a plurality of connectors configured to be fitted to a plurality of mating connectors, and a holder configured to hold the plurality of connectors in parallel so that the plurality of connectors are collectively fitted to the plurality of mating connectors. The holder may include a pair of halves, and the pair of halves may be coupled to each other with the plurality of connectors in between.

5 Claims, 31 Drawing Sheets

(56) References Cited

U.S. PATENT DOCUMENTS

| | | | | |
|---|---|---|---|---|
| 7,121,888 | B2 * | 10/2006 | Brandt | H01R 13/512<br>439/607.05 |
| 9,431,732 | B1 * | 8/2016 | Baldwin | H01R 13/5829 |
| 2001/0027056 | A1 * | 10/2001 | Sawayanagi | H01R 12/68<br>439/492 |
| 2003/0022549 | A1 * | 1/2003 | Castaldo | H01R 24/28<br>439/467 |
| 2006/0228932 | A1 * | 10/2006 | Komiyama | H01R 13/514<br>439/467 |
| 2014/0206242 | A1 * | 7/2014 | Torii | H01R 13/5829<br>439/731 |
| 2014/0302714 | A1 * | 10/2014 | Luettermann | H01R 13/514<br>439/607.55 |
| 2016/0181751 | A1 * | 6/2016 | Affeltranger | H01R 13/514<br>439/638 |

* cited by examiner

CONNECTOR DEVICE

CROSS-REFERENCE(S) TO RELATED APPLICATIONS

The present application claims priority to Korean Patent Application No. 10-2017-0022849, filed on Feb. 21, 2017, the entire contents of which is incorporated herein for all purposes by this reference.

BACKGROUND OF THE INVENTION

Field of the Invention

The present invention relates to a connector device having a connector and a holder.

Description of Related Art

In related art, a fuel injection device has two injector main bodies disposed in parallel in a single cylinder of an internal combustion engine, a power receiving connector provided in each injector main body, and a power feed connector which can be fitted to each power receiving connector.

In the related art, the power receiving connectors are individually fitted to the respective power receiving connectors. For the present reason, for example, in the case of a four-cylinder engine, a connector fitting operation should be performed eight times in total, resulting in a large workload.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing to improve workability in fitting connectors.

In accordance with an aspect of the present invention, a connector device includes a plurality of connectors that can be fitted to the mating connectors, and a holder for holding the plurality of connectors in parallel so that the plurality of connectors can be collectively fitted to the mating connectors.

The plurality of connectors are held side by side in the holder, and in the present state, the connectors are collectively fitted to the corresponding mating connectors. Therefore, it is not necessary to separately perform a fitting operation for each connector, and accordingly, the workload can be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
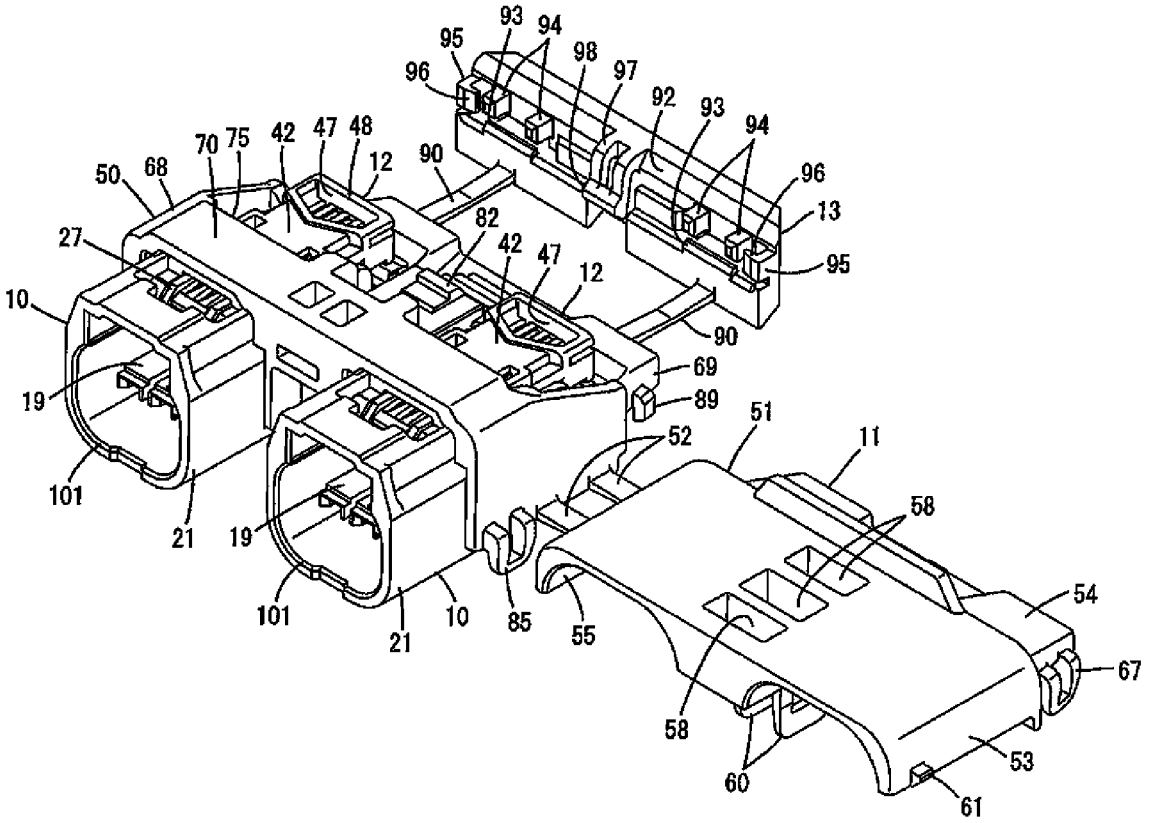
FIG. 1 is a perspective view showing a state in which two connectors are held in an upper holder in a connector device according to various exemplary embodiments of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalents parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is intended to cover not only the exemplary embodiments, but also various alternatives, modifications, equivalents and other embodiments, which may be included within the spirit and scope of the invention as defined by the appended claims.

A holder may include a pair of halves, and both the halves may be engaged with each other so that a plurality of connectors is disposed between the halves. Accordingly, the connectors can be easily disposed in the holder.

At least one of the halves may be provided with a locking portion configured for retaining the connector. Accordingly, it is possible to prevent the displacement of the connector with respect to the half when both the halves are engaged (operation of engaging both the halves). As a result, it is possible to smoothly carry out the operation of engaging both the halves.

The holder may include a connector accommodating space for individually accommodating the connectors, and the connectors may be accommodated in the connector accommodating space at least in a state in which movement in the alignment direction is allowed. For example, when a plurality of mating connectors is attached to an apparatus, there is a problem that the distance between the adjacent mating connectors in the aligning direction is not constant due to manufacturing errors or the like and may fluctuate. According to the above configuration, since the connectors move in the alignment direction in the connector accommodating space to be guided to the positions where they can be fitted to the mating connectors, the fluctuation in interval can be absorbed. As a result, the engagement operation between the connectors and the mating connectors can be performed smoothly.

Both the halves may be interconnected through a hinge. In the present case, the number of parts of the holder can be prevented from increasing.

Hereinafter, various exemplary embodiments of the present invention will be described with reference to the drawings. A connector device according to the various exemplary embodiments may include a connector 10, a holder 11, a detecting member 12, an operating member 13, and a terminal fitting 14. The connector 10 may be fitted to a mating connector 15 provided in a standby state on an injector (fuel injection valve) of a vehicle engine. Two injectors may be disposed in parallel in a cylinder. The mating connector 15 may be disposed individually in each injector.

A plurality of connectors 10 (two connectors per cylinder) may be provided to correspond to a plurality of mating connectors 15. The holder 11 may hold the two connectors 10 side by side. As will be described later, the respective connectors 10 may be collectively fitted to the corresponding mating connectors 15 through the holder 11. The detecting member 12 may be movably attached to the connectors 10 from the standby position to the detecting position. The operating member 13 may be a member for pushing the detecting member 12 and moving it to the detecting position. In the following description, in regards to front and rear directions, a direction in which the connector 10 faces the mating connector 15 at the start of engagement is a front direction. The vertical direction is based on FIG. 1 to FIG. 5, and the horizontal direction is based on FIG. 3.

Figure 12:
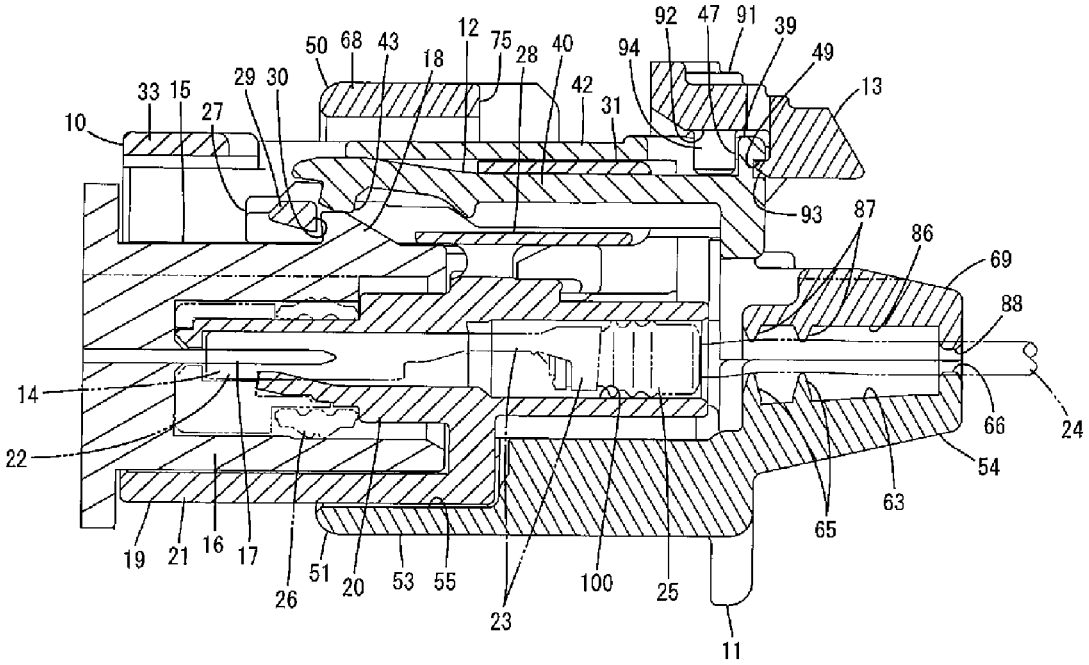
FIG. 12 is a side sectional view showing a state in which a connector is normally fitted to the corresponding mating connector.

The mating connector 15 may be provided with a hood portion 16 made of a synthetic resin. As shown in FIG. 12, a tub 17 of a mating terminal fitting may protrude in the hood portion 16. A mating locking portion 18 may protrude from the upper external wall of the hood portion 16.

Figure 22:
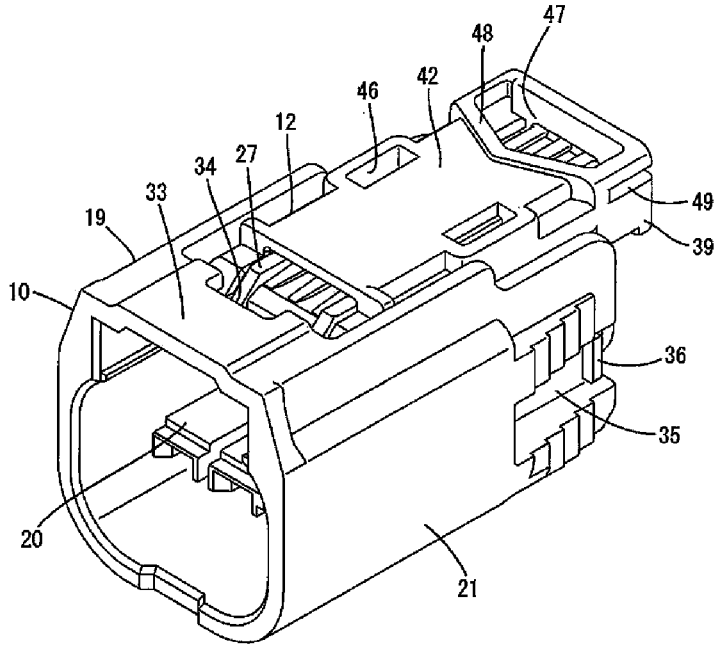
FIG. 22 is a perspective view of a connector in which a detecting member is held in a standby position.
Figure 23:
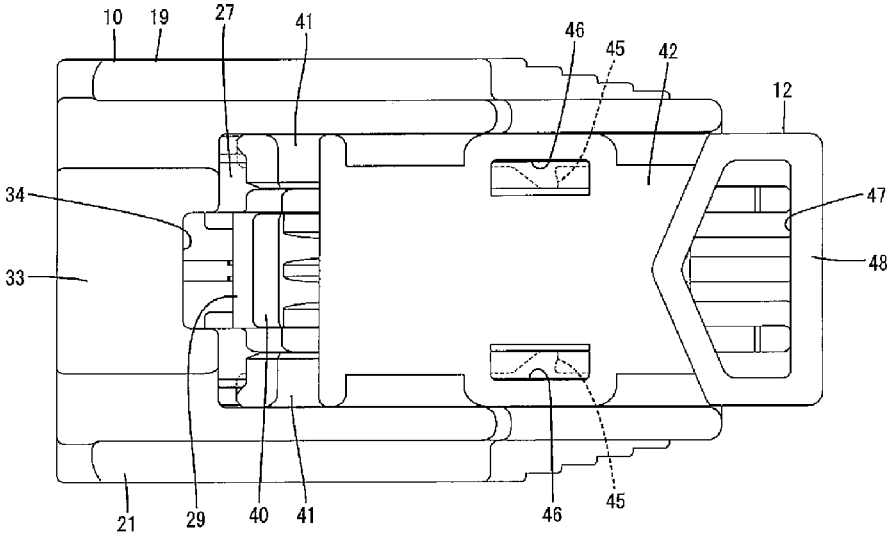
FIG. 23 is a plan view of FIG. 22.
Figure 24:
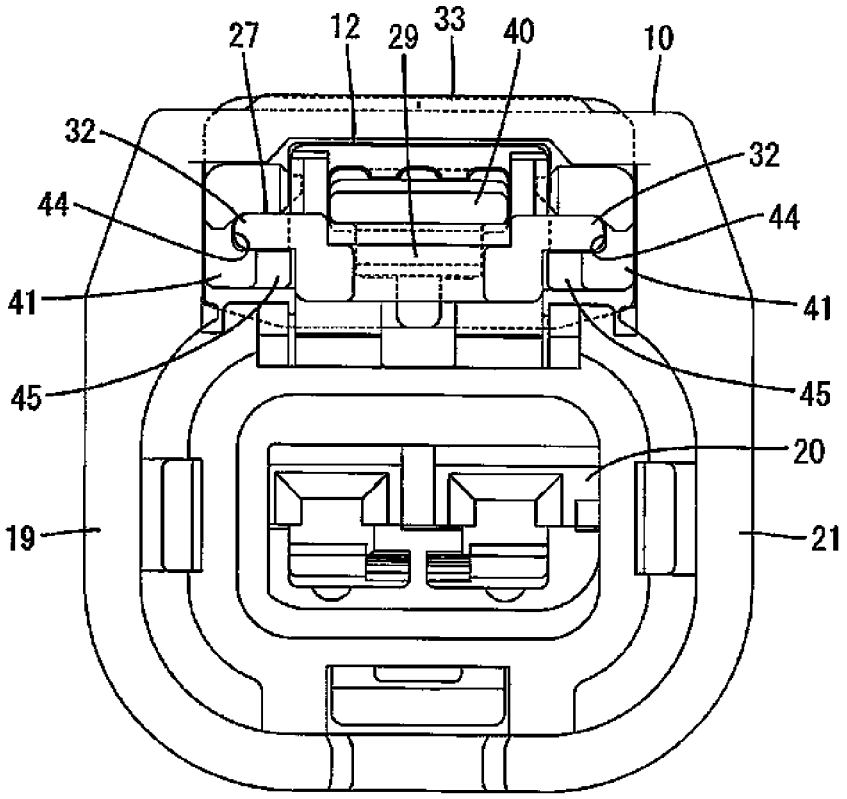
FIG. 24 is a front view of FIG. 22.

The connector 10 may be provided with a connector housing 19 including a synthetic resin. As shown in FIG. 22 to FIG. 24, the connector housing 19 may include a block-shaped housing main body 20, and a fitting tube portion 21 surrounding the external circumference of the housing main body 20.

As shown in FIG. 12, the terminal fitting 14 may be inserted into a cavity 100 of the housing main body 20 from behind. The terminal fitting 14 may be made of metal, and may have a connecting portion 22 and a barrel portion 23 located behind the connecting portion 22. The connecting portion 22 may be in the shape of a cylinder. The tub 17 of the mating terminal fitting mounted on the mating connector 15 may be inserted into the connecting portion 22 and connected to the connecting portion 22. The barrel portion 23 may be in the shape of an open barrel, and may be press-connected to an end portion of an electric wire 24. In addition, the barrel portion 23 may be press-connected to a rubber stopper 25 which is externally fitted to the electric wire 24. When the terminal fitting 14 is normally inserted into the cavity 100, the rubber stopper 25 may be elastically brought into close contact with the rear end portion of the internal circumferential surface of the cavity 100 so that the electric wire 24 is taken out of the rear surface of the housing main body 20. The electric wire 24 may be a covered wire surrounding a core wire with an insulating resin.

A seal ring 26 may be mounted on the external circumference of the housing main body 20. When the connector 10 is fitted to the mating connector 15, the seal ring 26 may be inserted between the housing main body 20 and the hood portion 16 to seal a space between the connector 10 and the mating connector 15.

Figure 10:
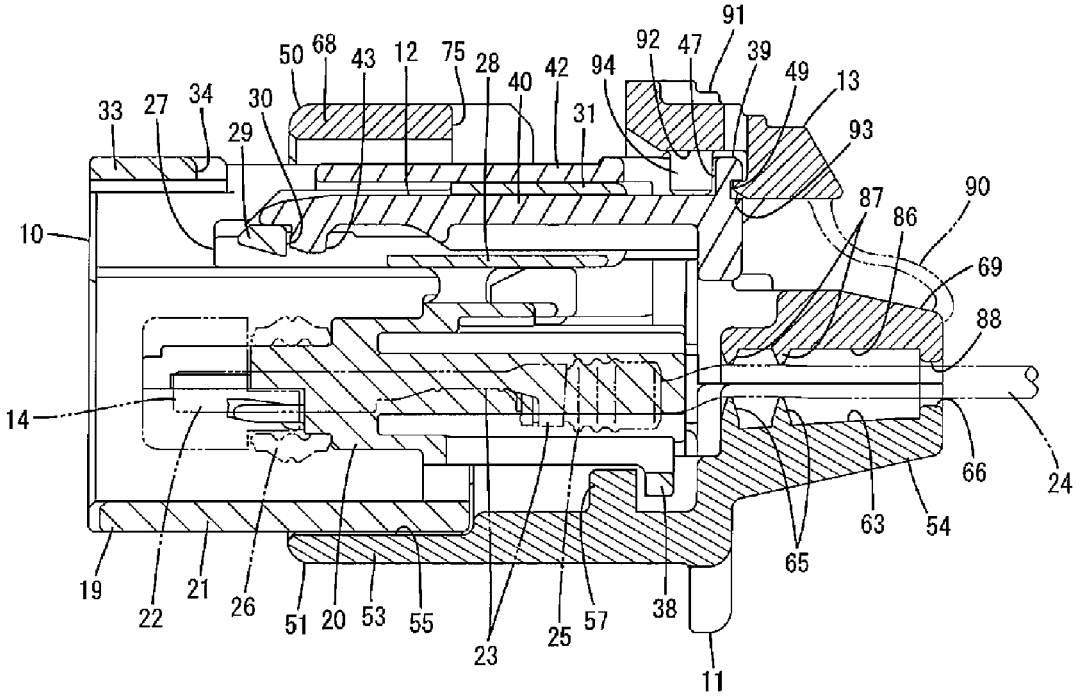
FIG. 10 is a sectional view cut along a line X-X in FIG. 8.
Figure 26:
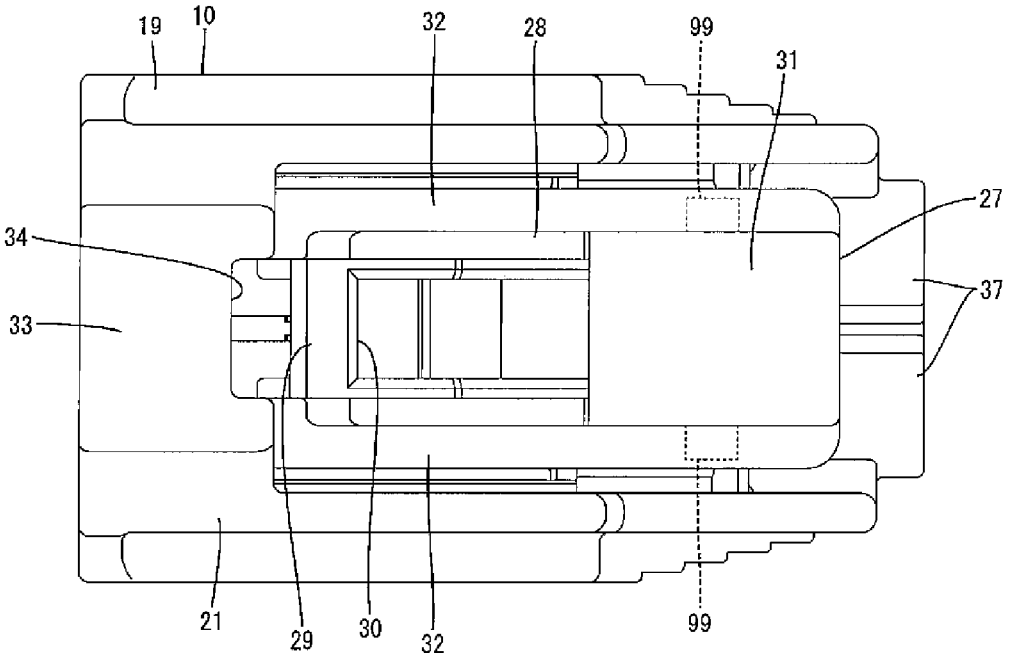
FIG. 26 is a plan view of the connector.

As shown in FIG. 10 and FIG. 26, a locking arm 27 may be connected to the upper surface of the housing main body 20. The locking arm 27 may include an arm portion 28 extending in the front and rear direction, and can be vertically bent. The arm portion 28 may include a locking body portion 29 at the front end portion, and a locking hole 30 penetrating in the vertical direction may be formed in the rear side of the locking body portion 29. In addition, the arm portion 28 may have a flat plate-shaped upper plate portion 31 at the rear portion. The upper plate portion 31 may be disposed to cover the rear upper portion of the locking hole 30. The arm portion 28 may include a pair of rail portions 32 extending in the front and rear direction at the left and right edge portions, and have a pair of leg portions 99 below both the rail portions 32.

The upper wall of the fitting tube portion 21 may include a wall portion 33 at the front end portion, and an opening portion 34 at the back of the wall portion 33. Before the detecting member 12 is attached, the locking arm 27 may be exposed to the upper side through the opening portion 34.

Figure 6:
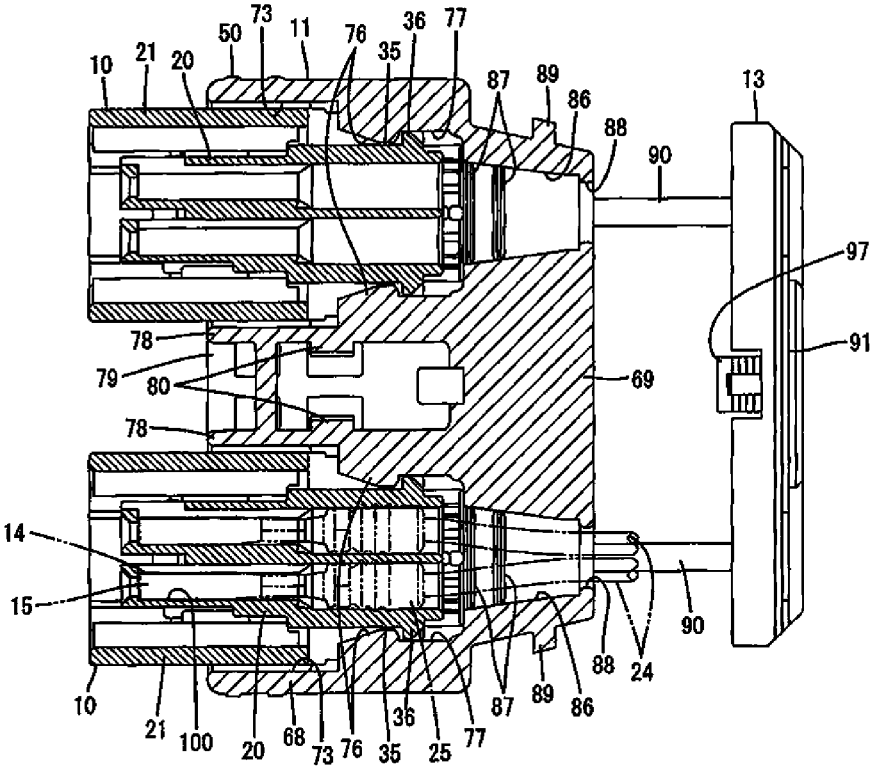
FIG. 6 is a cross-sectional view (cross-sectional view in a horizontal direction) of FIG. 2.
Figure 25:
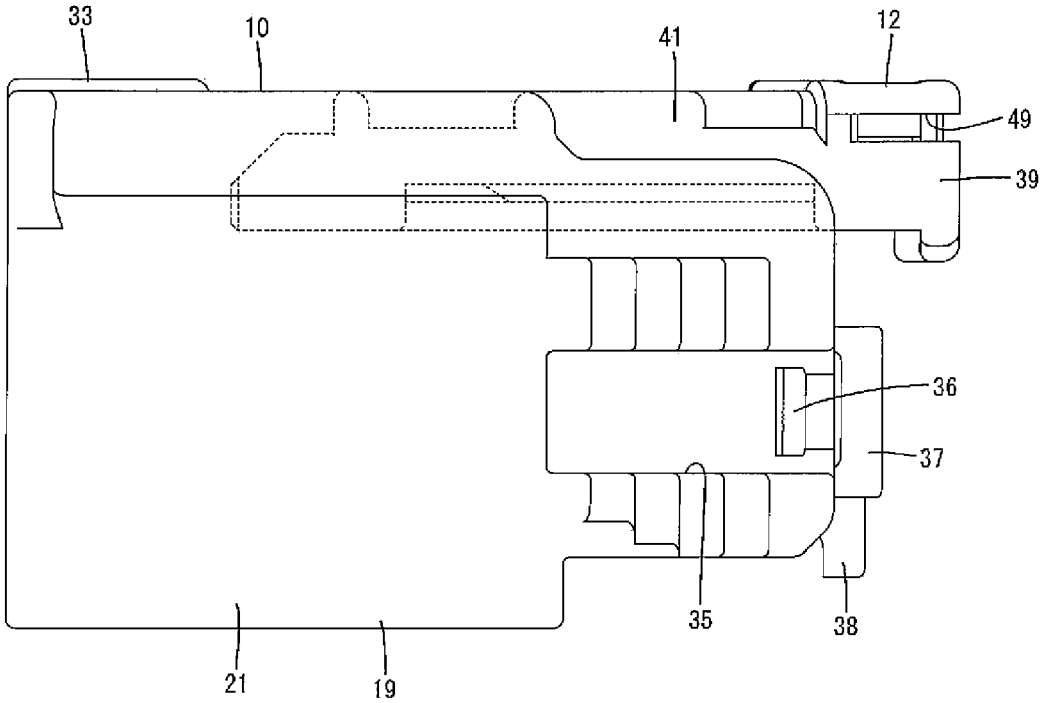
FIG. 25 is a side view of FIG. 22.

As shown in FIG. 6 and FIG. 25, both side walls of the fitting tube portion 21 may have a pair of locking grooves 35 on the external surface of the rear end portion. The locking groove 35 may extend in the front and rear direction to open the rear end portion of a side wall. Both side walls of the fitting tube portion 21 may have a pair of locking projections 36 at the rear end portion of the locking groove 35.

Figure 11:
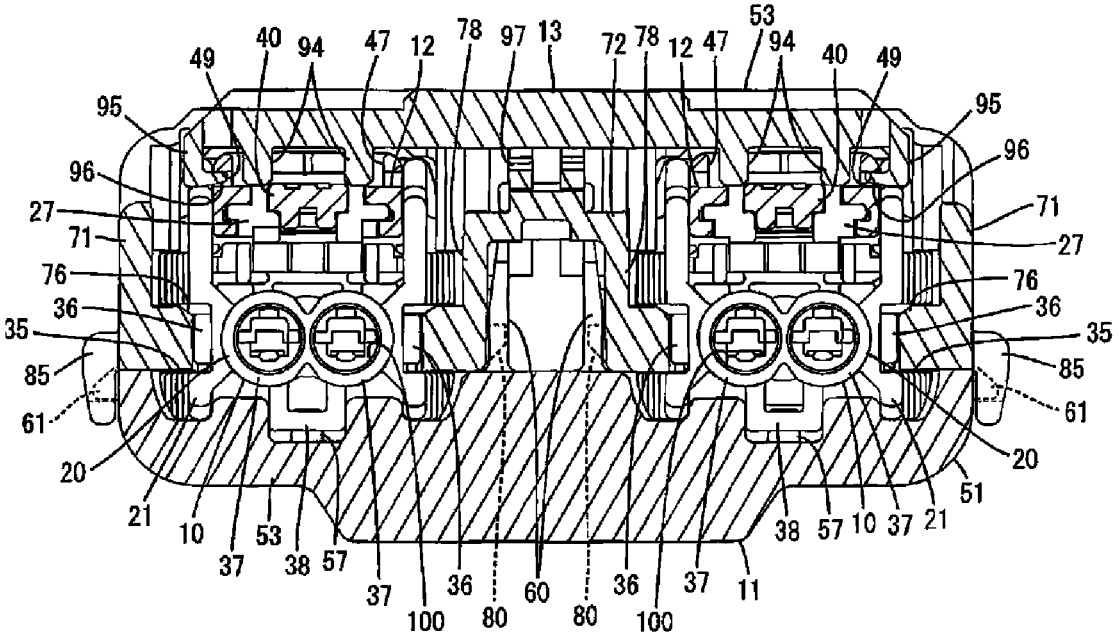
FIG. 11 is a sectional view cut along a line Y-Y in FIG. 9.
Figure 27:
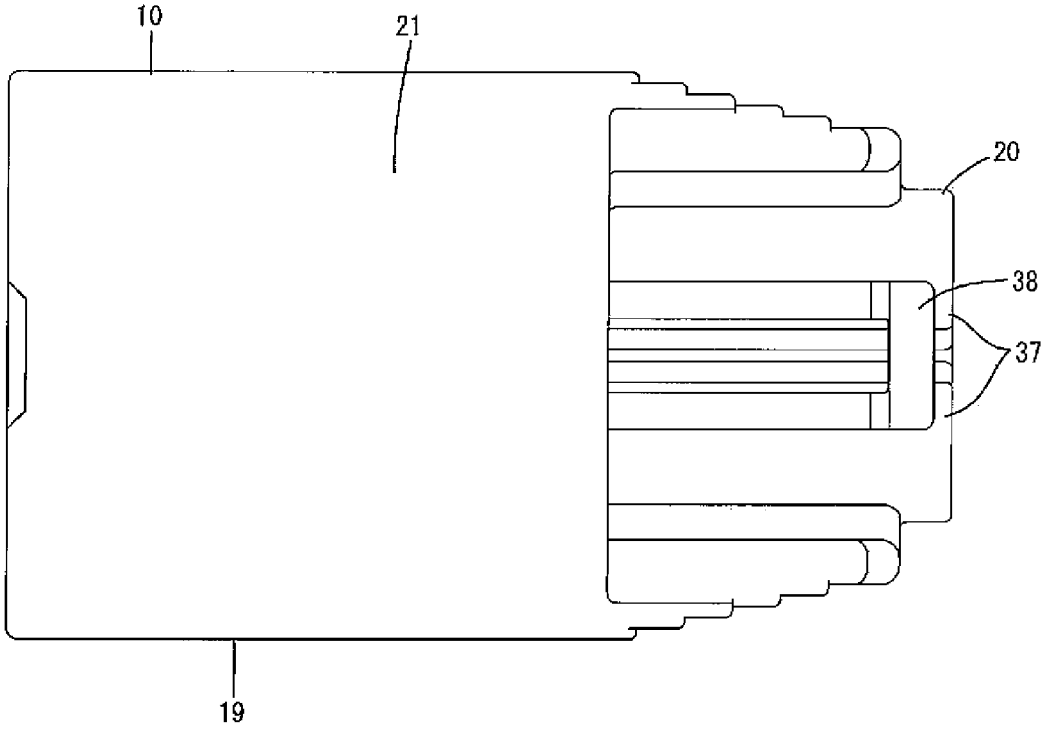
FIG. 27 is a bottom view of the connector.

As shown in FIG. 11 and FIG. 27, the housing main body 20 may have a pair of cavity tower portions 37 disposed horizontally side by side at the rear end portion. A locking projection 38 may be provided on the lower surface of both the cavity tower portions 37.

The detecting member 12 may be made of a synthetic resin, and may be movably attached to the arm portion 28 of the locking arm 27. As shown in FIG. 28 to FIG. 31, the detecting member 12 may have a base portion 39, an elastic locking portion 40, a pair of guide portions 41, and a cover portion 42. The base portion 39 may extend laterally from the rear end portion of the detecting member 12. The elastic locking portion 40 may have a shape extending forward from the center of the front surface of the base portion 39, and can be bent in the vertical direction thereof with respect to the rear end portion as a supporting point. The elastic locking portion 40 may have a stopper 43 protruding downward at the front end portion.

Figure 29:
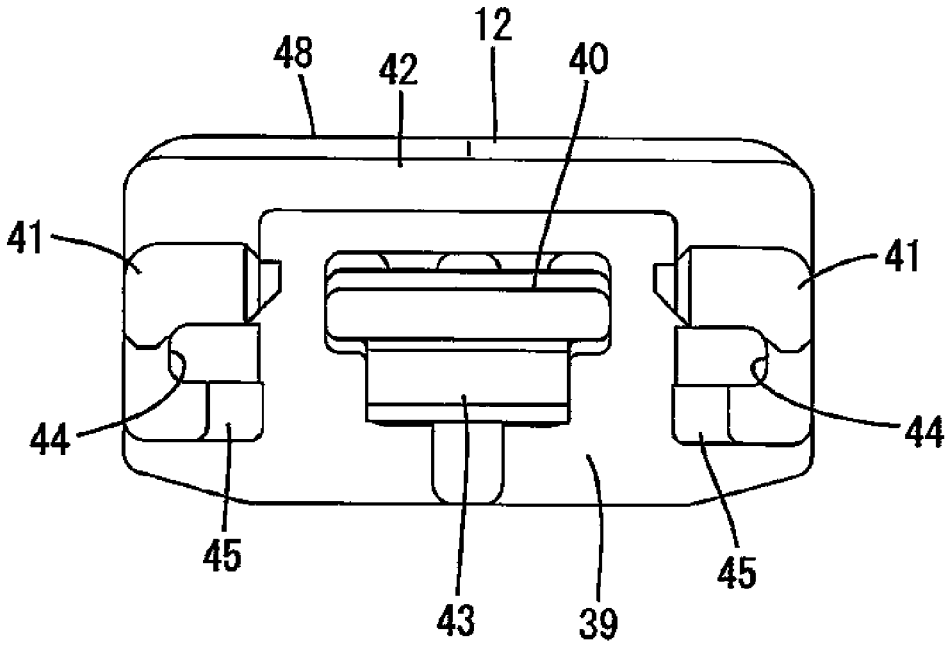
FIG. 29 is a front view of the detecting member.

The pair of guide portions 41 may have a shape extending forward from both end portions of the front surface of the base portion 39, and may not be substantially bent. As shown in FIG. 29, both the guide portions 41 may have guide grooves 44 extending in the front and rear direction on the internal surfaces (the facing surfaces of both the guide portions 41). Also, both the guide portions 41 may have a pair of stopper portions 45 protruding inwardly below the guide grooves 44.

Figure 28:
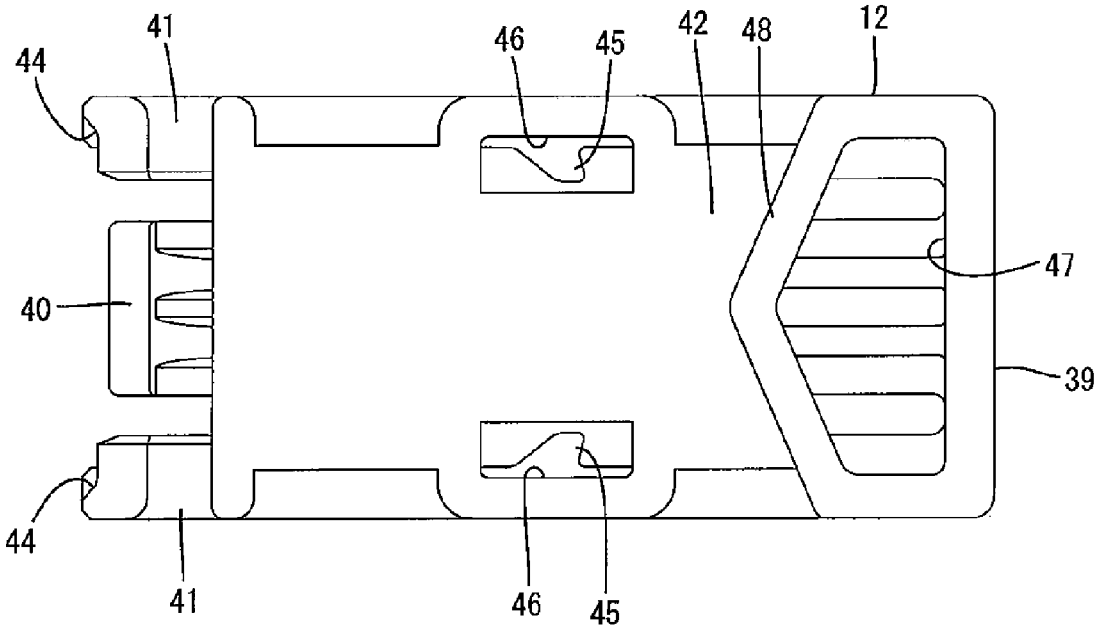
FIG. 28 is a plan view of the detecting member.

As shown in FIG. 28, the cover portion 42 may be interposed between the upper end portions of both the guide portions 41 to cover the upper side of the elastic locking portion 40. The cover portion 42 may have a pair of die-out holes 46 at both the end portions. The stopper portion 45 can be visually checked from above through the die-out hole 46. The cover portion 42 may include a window hole 47 at the rear end portion, and a frame portion 48 at the upper circumference of the window hole 47. The window hole 47 may have an opening width corresponding to the distance between both the guide portions 41. As shown in FIG. 22, the frame portion 48 may be formed in the shape of a rib surrounding the opening of the window hole 47 over the entire circumference.

Figure 30:
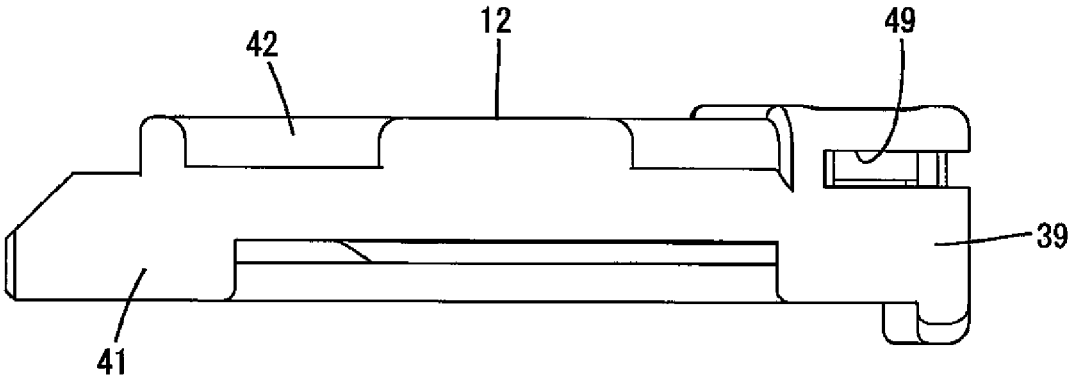
FIG. 30 is a side view of the detecting member.
Figure 31:
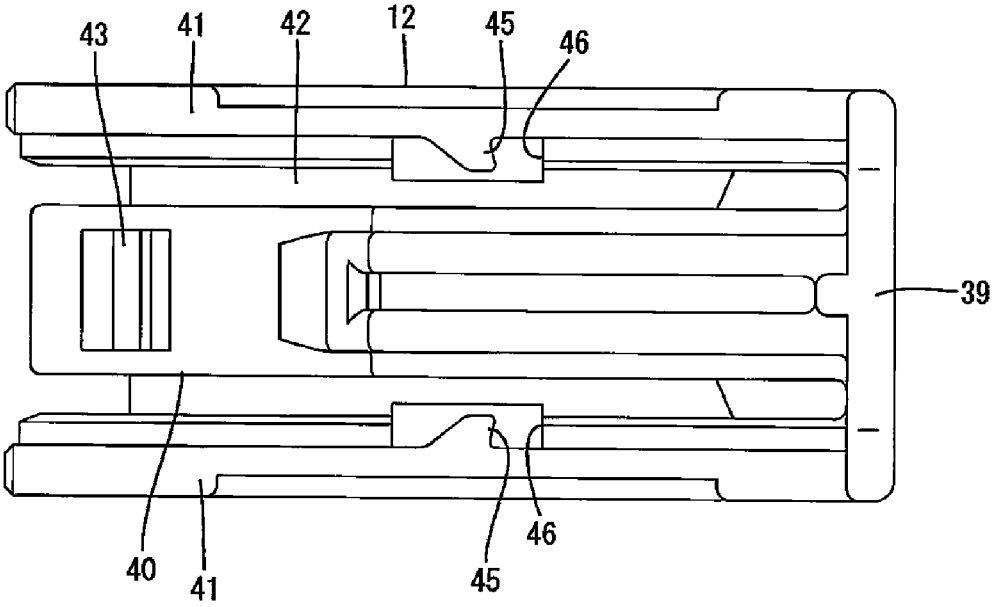
FIG. 31 is a bottom view of the detecting member.

As shown in FIG. 30, the detecting member 12 may have a stopping groove 49 extending from the rear surface of the base portion 39 to the external surfaces of both the guide portions 41. The stopping groove 49 may extend laterally from the rear surface of the base portion 39, and extend in the front-back direction from the external surfaces of both the guide portions 41, while being at the same height position as the upper end portion of the detecting member 12.

Figure 17:
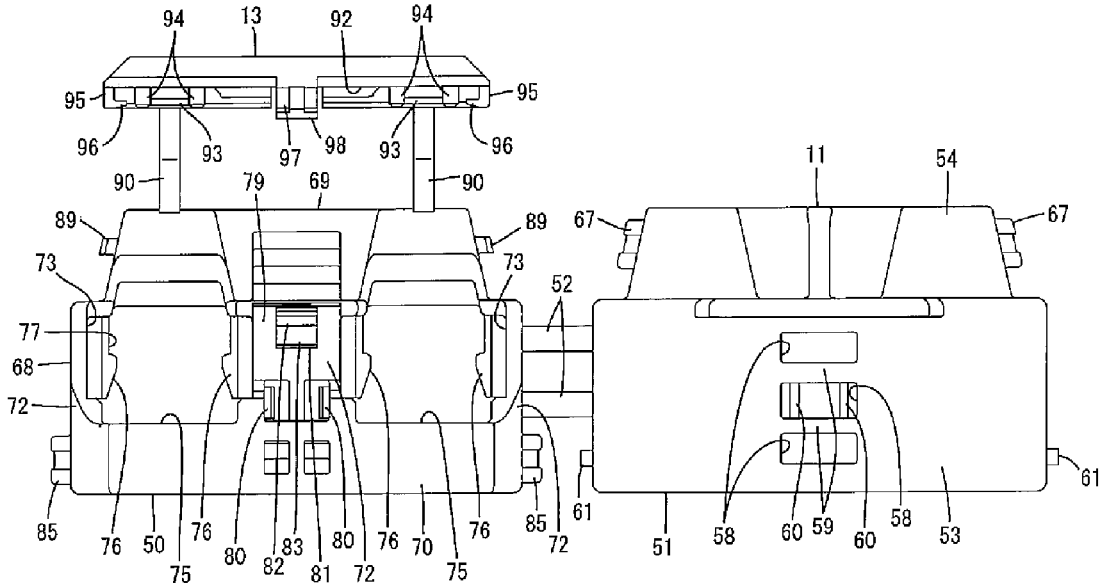
FIG. 17 is a plan view of a holder in an open state.

As shown in FIG. 17, the holder 11 may be made of a synthetic resin, and have a pair of halves 50 and 51. The halves 50 and 51 may be engaged with each other through a hinge (hereinafter, referred to as a halves connecting hinge 52).

Figure 2:
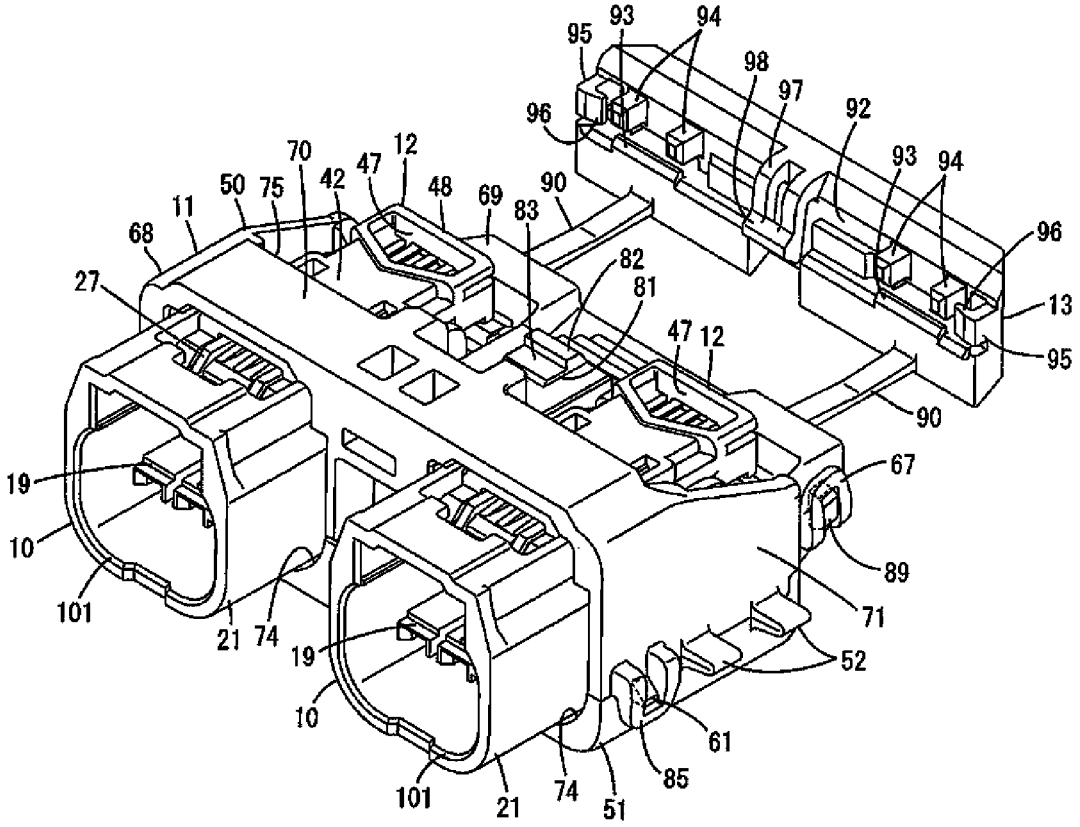
FIG. 2 is a perspective view showing a state in which a lower holder is locked to the upper holder in the state of FIG. 1.
Figure 3:
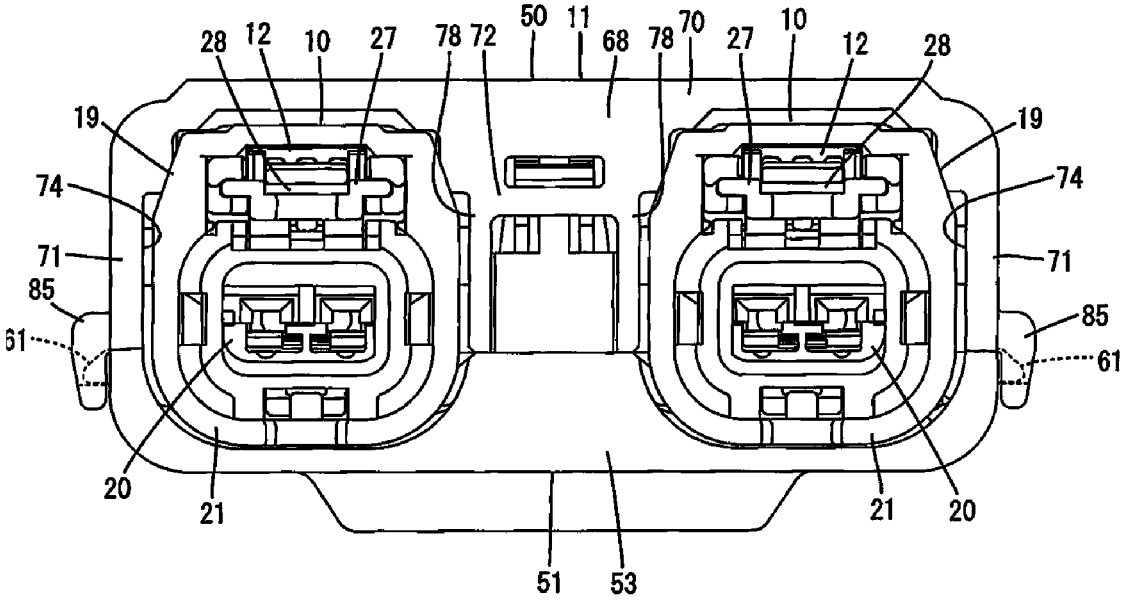
FIG. 3 is a front view of FIG. 2.
Figure 4:
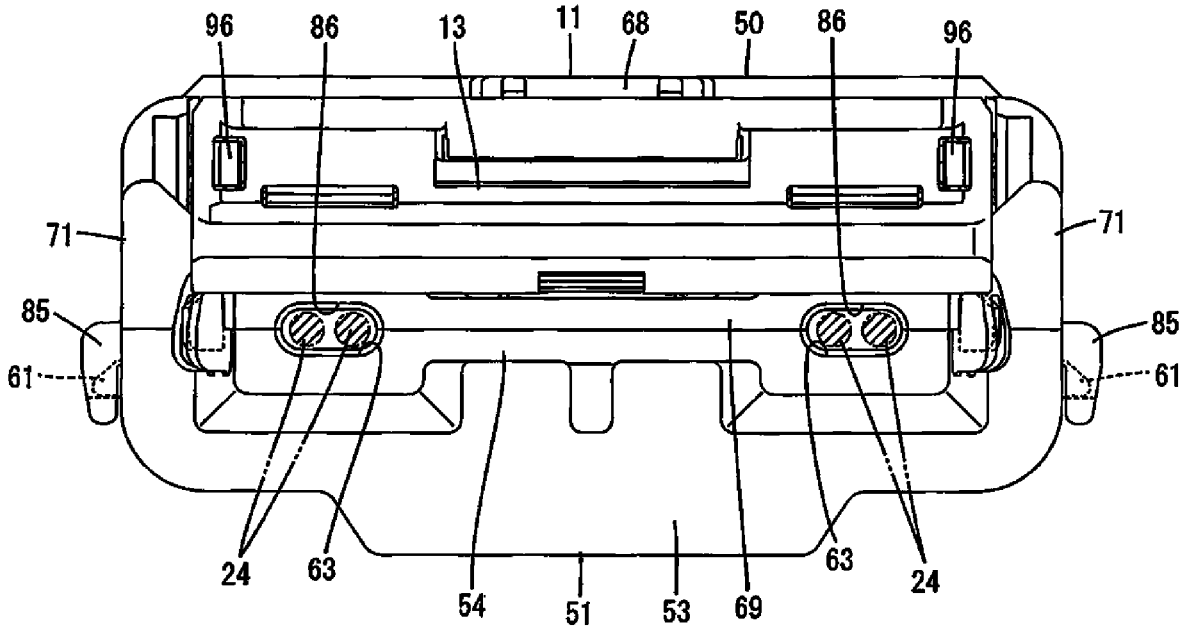
FIG. 4 is a rear view of FIG. 2.
Figure 9:
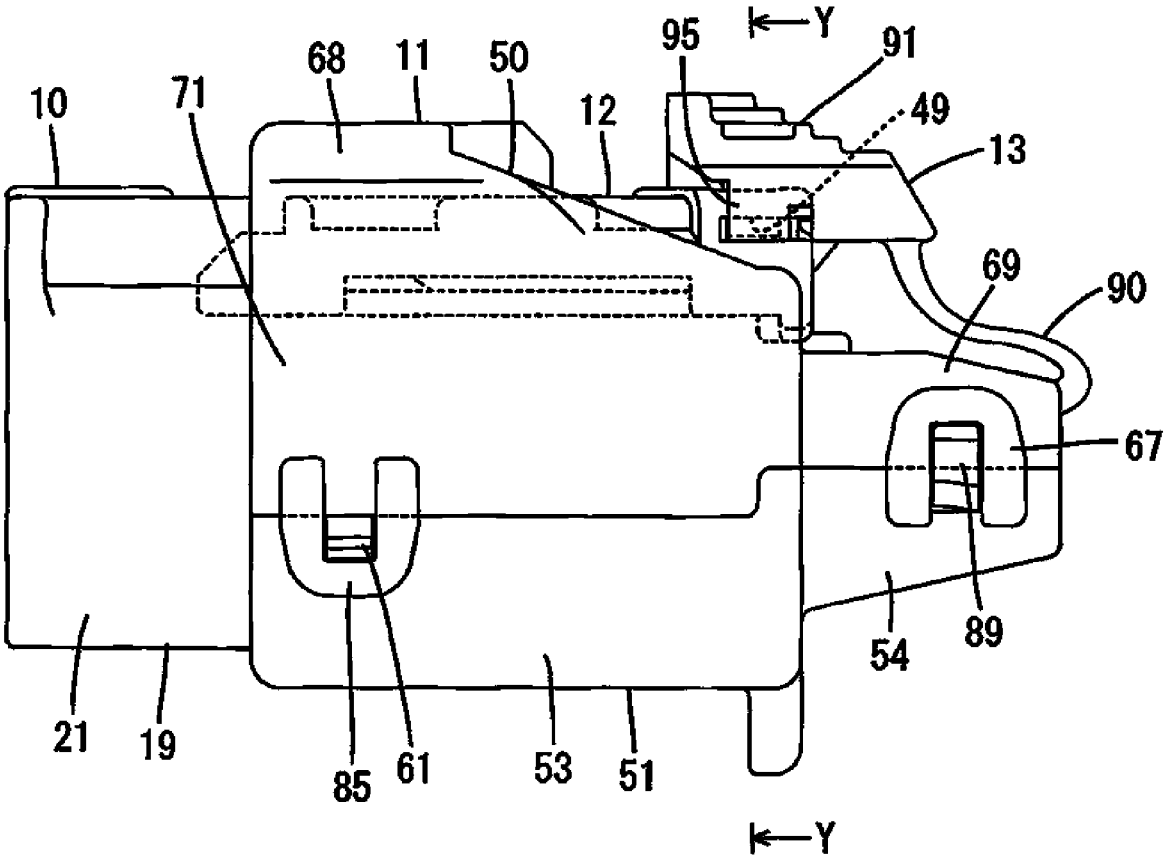
FIG. 9 is a side view of FIG. 7.

As shown in FIG. 2, FIG. 3 and FIG. 9, each of the halves 50 and 51 may include an upper holder 50 located on the upper side and a lower holder 51 located on the lower side. The upper holder 50 and the lower holder 51 may be coupled or separated in the vertical direction thereof. In the following description, the vertical direction of the upper holder 50 and the lower holder 51 may be defined based on the position when the upper holder 50 and the lower holder 51 are coupled.

Figure 20:
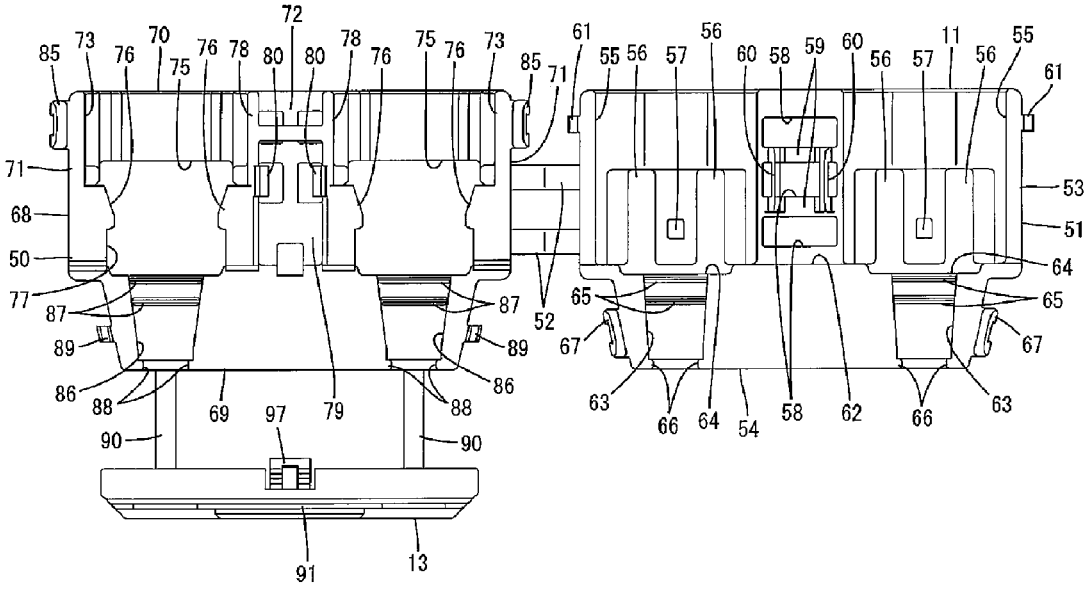
FIG. 20 is a bottom view of the holder in the open state.

As shown in FIG. 20, the lower holder 51 may include a lower connector accommodating portion 53 and a lower wire cover portion 54 located behind the lower connector accommodating portion 53. The lower connector accommodating portion 53 may have a pair of lower concave surfaces 55 on both the left and right sides of the internal surface (the surface facing the internal side in the coupled state). The lower concave surface 55 may have a shape substantially corresponding to the external surface of the lower end portion of the connector 10. The rear portion of the lower concave surface 55 may be located higher than the front portion, and have a pair of left and right protrusions 56. The protrusions 56 may extend in parallel in the front and rear direction. A lower locking portion 57 may protrude between the protrusions 56 of the lower concave surface 55.

Figure 19:
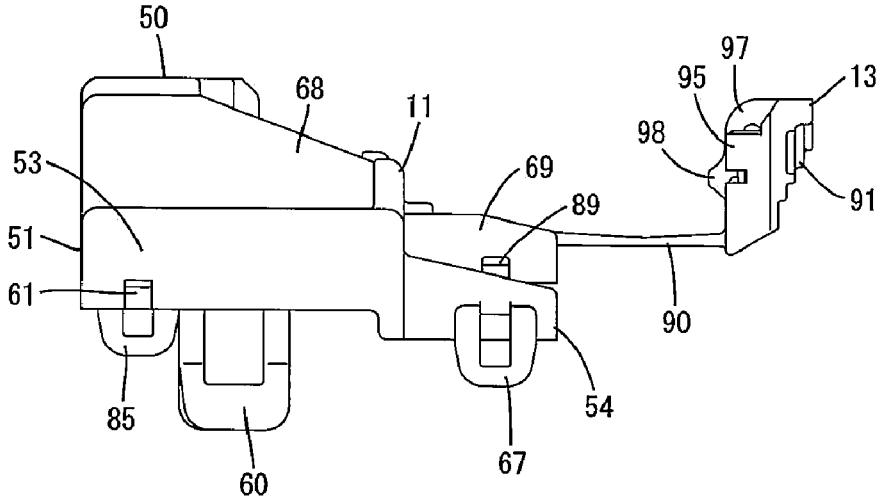
FIG. 19 is a side view of the holder in the open state.

The bottom wall of the lower connector accommodating portion 53 may include three thickness exception portions 58 in the front and rear direction at the right and left center portions between the lower concave surfaces 55, and have a pair of bridging ribs 59 between the thickness exception portions 58. The lower connector accommodating portion 53 may have a pair of left and right lower central holder locking portions 60 protruding upward from the bottom wall at the left and right center portions thereof. The lower center holder locking portion 60 may be in the shape of a plate frame having a portion penetrating in a lateral direction (thickness direction) (see FIG. 19), and may extend over the bridging ribs 59.

Both side walls of the lower connector accommodating portion 53 may have a pair of lower holder locking projections 61 at the front end portion of the external side. The lower holder locking protrusion 61 may have a shape protruding slightly in the lateral direction.

Figure 18:
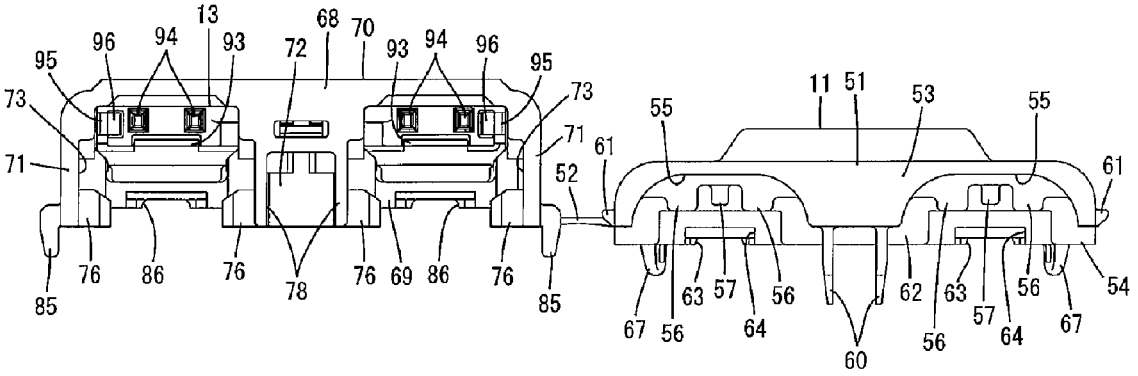
FIG. 18 is a front view of the holder in the open state.

As shown in FIG. 18 and FIG. 20, the lower connector accommodating portion 53 and the lower wire cover portion 54 may be partitioned by a vertical wall portion 62 extending in the left and right direction. As shown in FIG. 20, the lower wire cover portion 54 may protrude backwards from the upper end portion of the vertical wall portion 62, and may be formed in the shape of a horizontal plate extending laterally. The lower wire cover portion 54 may have a pair of lower wire insertion grooves 63 on the left and right sides of the upper surface thereof. The lower wire insertion groove 63 may extend in the front and rear direction as a whole. The width of the lower wire insertion groove 63 may be gradually narrowed in the rear direction. In addition, the depth of the lower wire insertion groove 63 may become deeper in the front direction (see FIG. 5). The front end portion of the lower wire insertion groove 63 may open to the inside of the lower connector accommodating portion 53 through a cut-out portion 64 formed in the upper end portion of the vertical wall portion 62. The upper surface of the lower wire cover portion 54 excluding both the lower wire insertion grooves 63 may be flat horizontally (see FIG. 4).

As shown in FIG. 20, the lower wire cover portion 54 may have a pair of front and rear lower contact pieces 65 on the front end portion of the bottom surface of the lower wire insertion groove 63. Both the lower contact pieces 65 may be in the shape of a rib having a triangular cross section, extending in the lateral direction (see FIG. 10), and may be disposed parallel to each other with an interval in the front and rear direction. The lower contact piece 65 on the front side may be formed continuously with the cut-out portion 64 of the vertical wall portion 62. The upper end portions of the lower leg portions 65 may be positioned at the same height, and disposed linearly lateral. The lower wire cover portion 54 may have a lower end portion corner rib 66 having a substantially 'U'-shaped cross section, extending laterally on the rear end portion of the groove bottom surface of the lower wire insertion groove 63.

Figure 21:
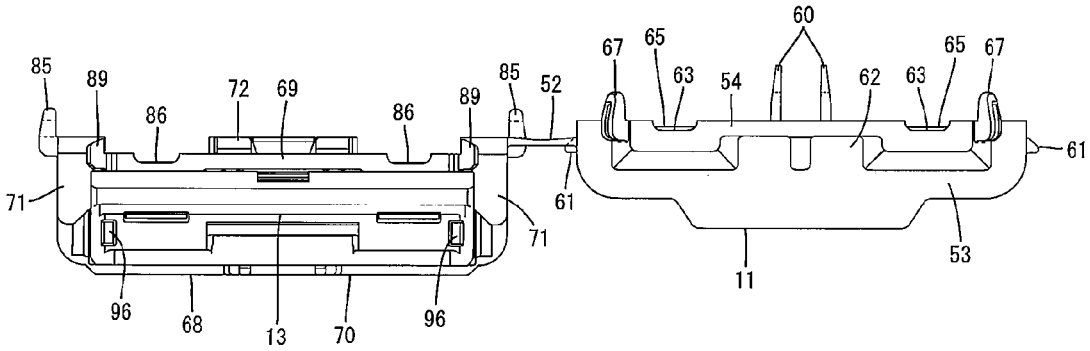
FIG. 21 is a rear view of the holder in the open state.

As shown in FIG. 21, the lower wire cover portion 54 may have a pair of lower holder locking pieces 67 at both the left and right end portions. The lower holder locking piece 67 may protrude upward from the side end portion of the lower wire cover portion 54, and may be formed in the shape of a plate frame having a portion penetrating in the left and right direction (thickness direction) (see FIG. 19).

As shown in FIG. 17 and FIG. 20, the upper holder 50 may include an upper connector accommodating portion 68 and an upper wire cover portion 69 located behind the upper connector accommodating portion 68. As shown in FIG. 18, the upper connector accommodating portion 68 may have a ceiling wall 70, side walls 71, and a center wall 72. The ceiling wall 70 may form the upper portion of the upper holder 50. The side walls 71 may form a pair to protrude downward from the left and right end portions of the ceiling wall 70, and form the lateral sides of the upper holder 50. The center wall 72 may protrude downward from the left and right center portions of the ceiling wall 70, and partition the inside of the upper holder 50 into left and right portions. The ceiling wall 70, the side walls 71 and the center wall 72 may each have an upper concave surface 73 on the internal lateral surface (the surface facing the internal side in the coupled state). The upper concave surface 73 may have a shape corresponding to the external upper surface of the connector 10, and may be disposed in pair on both right and left sides of the center wall 72 in the upper connector accommodating portion 68. When the upper holder 50 and the lower holder 51 are coupled, the upper and lower concave surfaces 73 and 55 may be continuous in the circumferential direction, and a pair of left and right connector accommodating space 74 may be defined therein (see FIG. 3).

The ceiling wall 70 may be formed in the shape of a base plate extending laterally. The upper holder 50 may have a pair of right and left openings 75 penetrating in the vertical direction thereof behind the ceiling wall 70. The opening 75 may be partitioned between the ceiling wall 70, the side walls 71, the center wall 72, and the upper wire cover portion 69. When the connector 10 is accommodated in the connector accommodating space 74, the detecting member 12 may be exposed upward through the opening 75 (see FIG. 2).

As shown in FIG. 17 and FIG. 20, both the side walls 71 and the center wall 72 may have a pair of upper locking portions 76 at the rear lower end portion of the upper concave surface 73. Both the upper locking portions 76 may have a protruding shape formed to face each other toward the inside (toward the connector accommodating space 74). Both the upper locking portions 76 may be formed in the shape of a rib extending in the front and rear direction, and have a cut-out shaped stopping recessed portion 77 on the internal surface of the rear end portion (surface that both the upper locking portions 76 face). The upper and lower surfaces of the upper locking portion 76 may be flat in the front and rear direction. The upper surface of the upper locking portion 76 can be visually checked through the opening 75.

As shown in FIG. 20, the center wall 72 may have a pair of left and right opposed wall portions 78 and a base wall portion 79. The opposed wall portions 78 may be formed in the shape of a plate that is flat in the front and rear direction, and disposed to face each other in the left and right direction. The opposed wall portions 78 may have an upper center holder locking portion 80 on the internal surfaces (surfaces that the opposed wall portions 78 face). The upper center holder locking portion 80 may have a shape protruding slightly toward the inside. The upper locking portion 76 may be provided on the external surface of the opposed wall portion 78.

Figure 15:
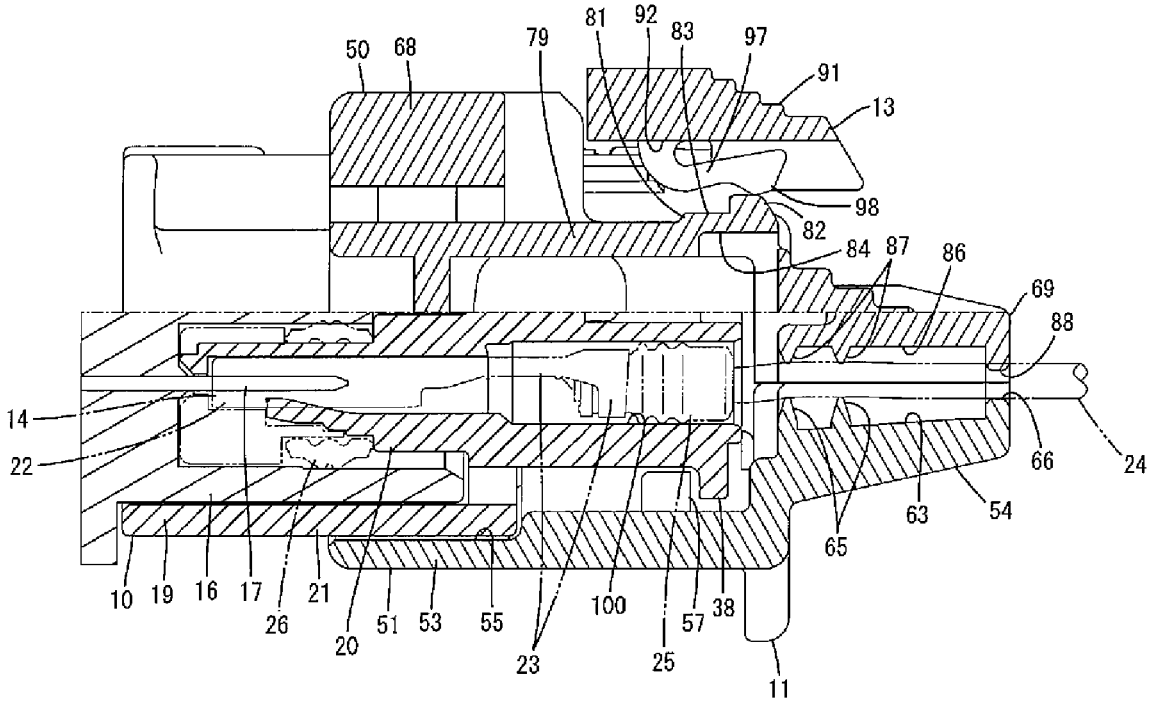
FIG. 15 is a view showing a state where a locking piece and a sound generating portion are cut to a visible position in the state of FIG. 13.
Figure 16:
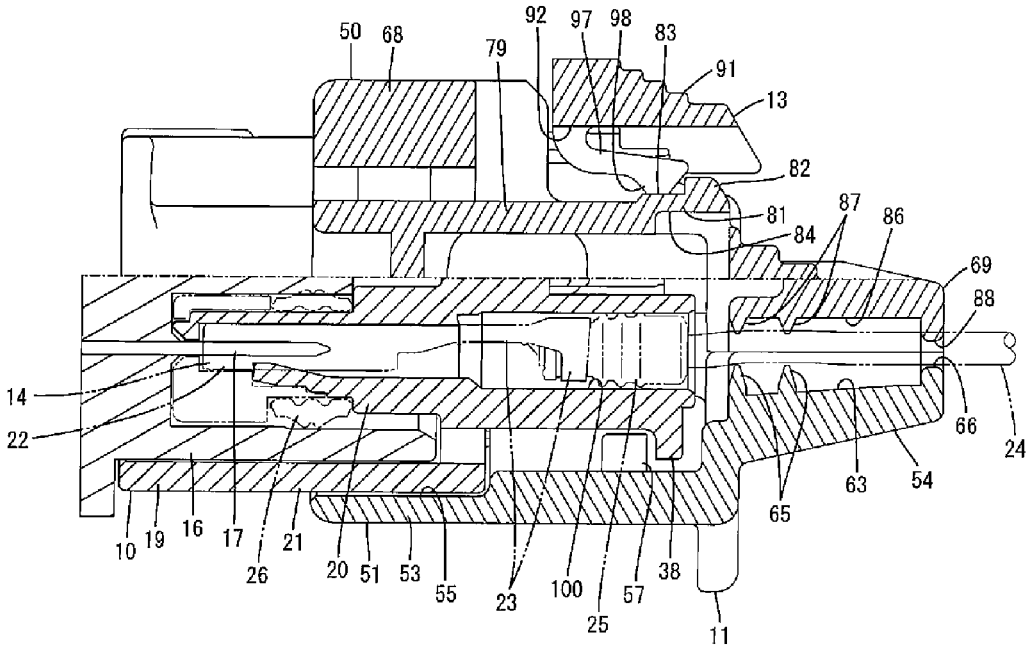
FIG. 16 is a view showing a state where a locking piece and a sound generating portion are cut to a visible position in the state of FIG. 14.

The base wall portion 79 may be disposed between the opposed wall portions 78, and disposed horizontally wherein the wall surfaces face the up and down directions. As shown in FIG. 2, FIG. 15, and FIG. 16, the base wall portion 79 may have a sound generating portion 81 at the rear end portion of the upper surface. The sound generating portion 81 may be located higher than the surrounding portion. The sound generating portion 81 may have an operating member locking portion 82 protruding upward from the rear end portion of the upper surface. A portion of the upper surface of the sound generating portion 81 which is Aad of the operating member locking portion 82 may be a collision receiving surface 83 which is flat along the front and rear direction. The front surface of the operating member locking portion 82 may be disposed along the vertical direction thereof to be orthogonal to the collision receiving surface 83. The base wall portion 79 may have a resonance space portion 84 below the sound generating portion 81. The resonance space portion 84 may extend in the front and rear direction to open to the rear end portion of the base wall portion 79.

Both the side walls 71 may have a pair of upper holder locking pieces 85 at the front end portions of the left and right external side surfaces. The upper holder locking piece 85 may be formed in the shape of a plate frame protruding downward from the external side surface of the side wall 71 and having a portion penetrating in the lateral direction (the thickness direction of the plate) (see FIG. 19).

The upper wire cover portion 69 may be formed in the shape of a horizontal plate extending laterally. As shown in FIG. 20, the front end portion of the upper wire cover portion 69 may be connected to the rear end portions of both the side end portion walls 71 and the rear end portion of the center wall 72, respectively. The upper wire cover portion 69 may have a pair of upper wire insertion grooves 86 on the left and right sides of the lower surface. The upper wire insertion grooves 86 may extend in the front and rear direction as a whole, and the width of each upper wire insertion groove 86 may be gradually narrowed in the rear direction. The front end portion of the upper wire insertion groove 86 may open to the connector accommodating space 74. A portion of the lower surface of the upper wire cover portion 69 excluding the upper wire insertion groove 86 may be flat horizontally (see FIG. 4).

The upper wire cover portion 69 may have a pair of front and rear upper contact pieces 87 at the front end portion of the bottom surface of the upper wire insertion groove 86. Each of the upper contact pieces 87 may be formed in the shape of a rib having a substantially triangular cross section (see FIG. 10), and may be disposed in parallel with an interval in the front and rear direction. The front side of the upper contact piece 87 may face the connector accommodating space 74 at the front end portion of the upper wire cover portion 69. The lower end portions of both the upper contact pieces 87 may be positioned at the same height, and disposed linearly in the left and right direction. The upper wire cover portion 69 may have an upper end portion corner rib 88 being substantially 'U'-shaped in and extending laterally to the rear end portion of the groove bottom surface of the upper wire insertion groove 86.

The upper wire cover portion 69 may have a pair of upper holder locking projections 89 at both the left and right end portions. The upper holder locking projection 89 may have a shape protruding slightly in the lateral direction.

Between the side wall 71 of the upper holder 50 and the side wall of the lower holder 51, a pair of front and rear half connecting hinges 52 may be provided. Both the half connecting hinges 52 may be in the shape of a flexible band disposed parallel to each other. As shown in FIG. 20, in the state where the upper holder 50 and the lower holder 51 are disposed side by side (also, in a separated state or in a molded state), both the half connecting hinges 52 may extend in the left and right direction.

The operating member 13 may be made of a synthetic resin, and formed in the shape of a plate piece extending in the left and right direction, as shown in FIG. 1. The operating member 13 may be connected to and integrated with the holder 11 through a hinge (hereinafter, referred to as operating member connecting hinge 90). As shown in FIG. 20, a pair of operating member connecting hinges 90 may be disposed in the left and right direction between the operating member 13 and the upper wire cover portion 69. When the upper holder 50 and the lower holder 51 are in the separated state, the plate surfaces of the operating member 13 may be disposed in the front and rear directions, and an end portion of the operating member connecting hinge 90 may be connected to the left or right end portions of the plate surface disposed in the front direction. The other end portion of the operating member connection hinge 90 may be connected to a portion corresponding to the rear end portion of the upper wire insertion groove 86 of the upper wire cover portion 69.

Figure 7:
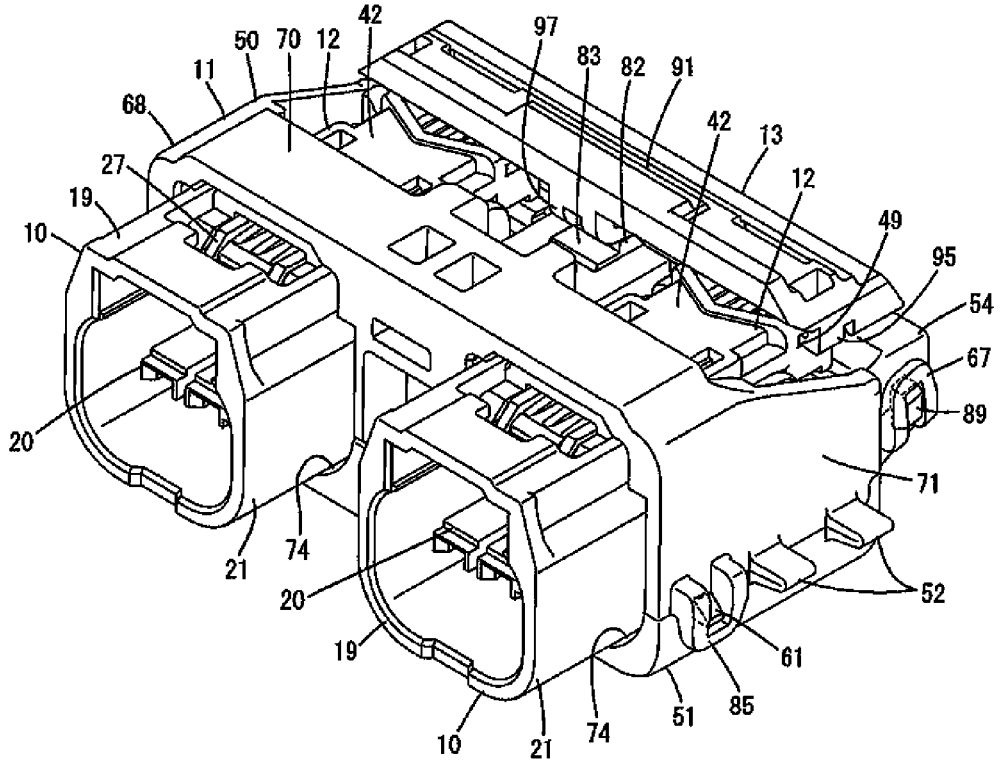
FIG. 7 is a perspective view showing a state in which an operating member is engaged with a detecting member in the state of FIG. 2.
Figure 8:
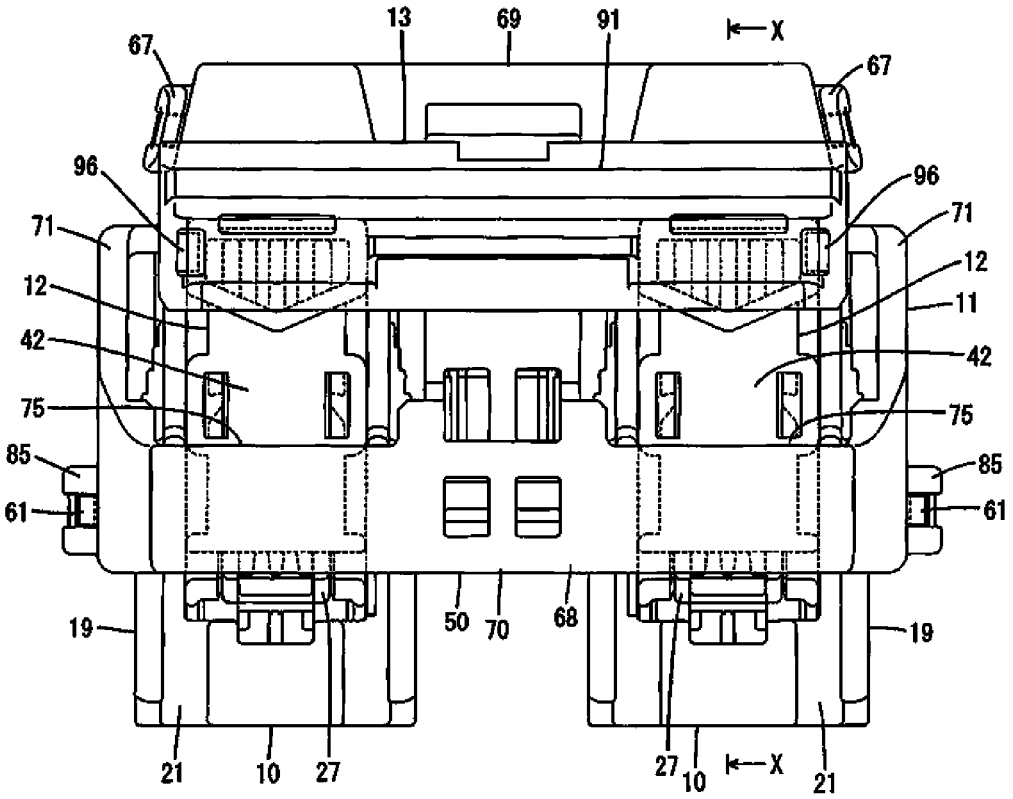
FIG. 8 is a plan view of FIG. 7.

The operating member 13 may come into contact with the detecting member 12 from behind, and push the detecting member 12 forward with respect to the connector 10 to move the detecting member 12 to the detecting position. In the following description, the up-and-down direction and the back-and-forth direction of the operating member 13 may be defined based on the position (the state shown in FIG. 7) of the operating member 13 when the detecting member 12 is pressed. The plate surface (the surface to which the end portion of the operating member connecting hinge 90 is connected) facing the front of the operating member 13 may correspond to the lower surface of the operating member 13.

As shown in FIG. 9, the upper surface of the operating member 13 as a whole may be formed in the shape of an inclined surface inclined upward toward the front. On the upper surface of the operating member 13, a non-slip portion 91 may be provided by a plurality of grooves extending in the left and right direction (see FIG. 20).

Figure 5:
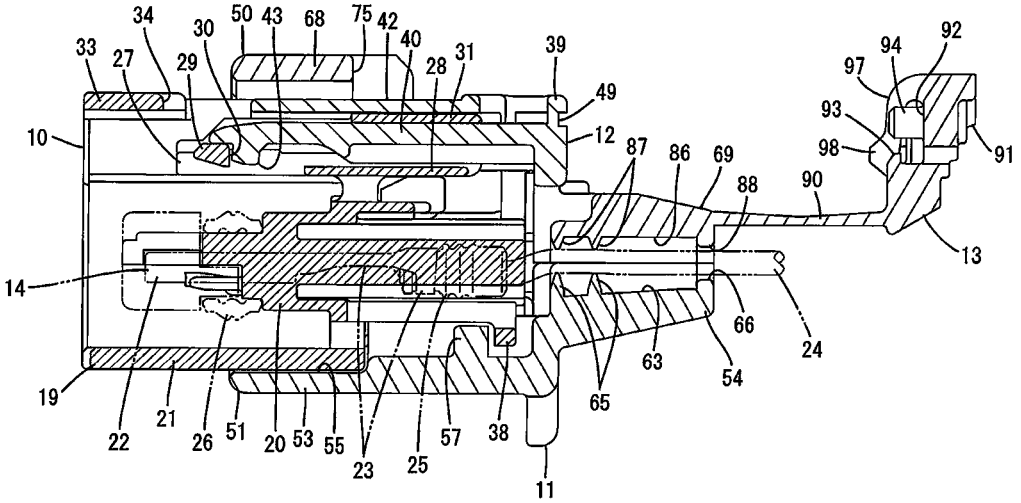
FIG. 5 is a side sectional view (sectional view in the side direction) of FIG. 2

As shown in FIG. 5 and FIG. 17, the operating member 13 may have a cut-out type press-fit recessed portion 92 at a connection portion between the lower surface and the front surface. The press-fit recessed portion 92 may have a substantially 'L'-shaped in cross-section, wherein the internal side surface (the surface toward the front direction) may be disposed substantially along the vertical direction thereof, and the internal upper surface (the surface facing downward) may be disposed substantially along the front and rear direction.

The press-fit recessed portion 92 may have a pair of stopping protrusions 93 at both the left and right end portions of the lower end portion of the internal surface. The stopping protrusion 93 may be formed in the shape of a rib extending in the left and right direction. The press-fit recessed portion 92 may have a pair of left and right protruding portions 94 at both the left and right end portions of the internal surface. Each protruding portion 94 may be formed in the shape of a square pillar.

As shown in FIG. 17, the press-fit recessed portion 92 may have elastic retaining pieces 95 at the left and right external sides of the internal surface. The elastic retaining pieces 95 may be exposed in pair at the left and right end portions of the operating member 13. The elastic retaining piece 95 may protrude downward from the internal upper surface of the press-fit recessed portion 92, and have a retaining protrusion 96 protruding inwardly from the lower end portion (the opposed directions of both the elastic retaining pieces 95).

The press-fit recessed portion 92 may have a locking piece 97 (striking portion) on the right and left center portion of the internal surface. As shown in FIG. 16, the locking piece 97 may protrude downward from the internal surface of the press-fit recess portion 92, and then extend rearward. The locking piece 97 can be bent in the vertical direction thereof with respect to the front end portion as a supporting point. The locking piece 97 may have a projection 98 projecting downward at the rear end portion. The lower surface of the projection 98 may be a flat surface along the front and rear direction. The front surface of the projection 98 may be formed in the shape of an inclined surface inclined rearward toward the down direction. In addition, the rear surface of the projection 98 may be formed in the shape of an inclined surface inclining forward toward the down direction. As shown in FIG. 1, the locking piece 97 may protrude from the internal surface of the press-fit recessed portion 92 in a bifurcated shape, and the bifurcated portion may be connected through the protrusion 98.

The structure of the connector device according to the various exemplary embodiments of the present invention has been described above. Hereinafter, a method of assembling the connector device, and a method of disengaging the connector device will be described.

First, the detecting member 12 may be attached to the locking arm 27 of the connector 10 from behind. At the present time, both the rail portions 32 of the arm portion 28 may be inserted into the guide grooves 44 of both the guide portions 41 (see FIG. 24) so that the upper plate portion 31 may be disposed between the elastic locking portion 40 and the cover portion 42 (see FIG. 5). In addition, the stopper portion 45 may be disposed to be engageable with the leg portion 99 from the front. The stopper 43 of the elastic locking portion 40 may enter the locking hole 30 of the arm portion 28 so that the stopper 43 may be disposed to be engageable with the locking body portion 29 from the rear. As a result, the detecting member 12 may be kept to be prevented from moving to the standby position with respect to the connector 10.

Subsequently, the two connectors 10 may be held in the upper holder 50 (see FIG. 1). The upper portion of the connector 10 may be inserted into the upper concave surface 73 of the upper holder 50 from the front. In a process of inserting the upper portion of the connector 10 into the upper concave surface 73, both the locking projections 36 may interfere with the upper locking portion 76, and as a result, the side wall 71 and the opposite wall portion 78 may be bent. When the upper portion of the connector 10 is normally inserted into the upper concave surface 73, the side wall 71 and the opposite wall portion 78 may elastically return to the original state. The upper locking portion 76 may be inserted into the locking groove 35 of the connector 10, and the locking projection 36 may be inserted into the stopping recessed portion 77, so that the upper locking portion 76 may be engaged with the locking projection 36 (see FIG. 6). The connector 10 may be disposed in front of the upper wire cover portion 69 to face each other. Both the upper and lower surfaces of the upper locking portion 76 may be disposed to be able to contact the upper and lower groove surfaces of the locking groove 35 (see FIG. 11). Thus, when the holder 11 is in the separated state, the connector 10 may be maintained in a state where it is prevented from pulling out of the upper concave surface 73 of the upper holder 50.

Subsequently, the lower holder 51 may be pivoted through the half connecting hinge 52, and coupled with the upper holder 50. The lower holder locking projection 61 may be elastically hooked to the upper holder locking piece 85, and the upper holder locking projections 89 may be elastically hooked to the lower holder locking piece 67 (see FIG. 9). In addition, the upper central holder locking portion 80 may be elastically hooked to the lower central holder locking portion 60 (see FIG. 11). As a result, the lower holder 51 and the upper holder 50 may be strongly held in a coupled state.

When the upper holder 50 and the lower holder 51 are coupled, a pair of left and right connector accommodating space 74 may be divided, and the connectors 10 may be respectively accommodated in both the connector accommodating space 74 (see FIG. 2 and FIG. 3). At the present time, the locking projections 38 may enter the space surrounded by the lower locking portions 57, the vertical wall portions 62, and the protruding portions 56 of the lower holder 51 (see FIG. 20). The locking projection 38 may be disposed to be engageable with the lower locking portion 57 (see FIG. 5), and as already described above, the upper locking portion 76 may be disposed to be engageable with the locking projection 36 (See FIG. 6), so that the connector 10 may be prevented from coming out of the holder 11 forward thereof.

The connector 10 may have a rattle between the upper concave surface 73 and the lower concave surface 55, and may be inserted with a sufficient clearance in the vertical and lateral directions into the connector accommodating space portion 74 of the holder 11. Therefore, the connector 10 may be allowed to move slightly in the vertical direction thereof and the lateral direction in the connector accommodating space portion 74 of the holder 11.

In the state where both the connectors 10 are held by the holder 11, the front portions of both the connectors 10 may be disposed to be exposed forward from the front end portion of the holder 11, and the front end portions of both the connectors 10 may be disposed at the same position in the front and rear direction. In addition, the detecting member 12 may be disposed to be exposed to the opening 75 of the upper holder 50.

When the upper holder 50 and the lower holder 51 are coupled, the lower wire cover portion 54 and the upper wire cover portion 69 may overlap in the vertical direction thereof. The flat upper surface of the lower wire insertion groove 63 and the flat lower surface of the upper wire insertion groove 86 may be brought into close contact with each other along the left and right sides (see FIG. 4). Each wire 24 drawn out from the connector 10 may be disposed side by side in a line between the lower wire insertion groove 63 and the upper wire insertion groove 86. At the present time, the lower contact piece 65 and the upper contact piece 87 may be disposed at the same position in the front and rear direction, and the lower contact piece 65 may contact the lower portion of each wire 24, and the upper contact piece 87 may contact the upper portion of each the wire 24, so that the wires 24 are inserted in the vertical direction thereof between the lower contact piece 65 and the upper contact piece 87 (see FIG. 5).

Subsequently, the holder 11 may be gripped and the two connectors 10 held by the holder 11 may be disposed substantially in the frontal position with respect to the two mating connectors 15 provided in a cylinder. In the present state, the holder 11 may come close to the mating connector 15. As such, the two connectors 10 may be collectively fitted to the mating connectors 15 through the holder 11. In the fitting process, the connector 10 may come into contact with the front end portion of the lower wire cover portion 54 and the front end portion of the upper wire cover portion 69, so that the pressing force from the mating connector 15 is received.

In the present case, it is difficult to continuously maintain the distance in the alignment direction of the two mating connectors 15 provided in a cylinder, and there is a problem that the distance between products tends to vary. In consideration of the present case, in the various exemplary embodiments, as described above, both the connectors 10 may be accommodated in the connector accommodating space 74 of the holder 11 to be movable in the left and right direction and the up and down direction. For the present case, when the connectors 10 start being fitted to the mating connectors 15, the hood portions 16 of the mating connectors 15 may slide on a guide surface 101 (see FIG. 2) provided on the front-end opening protrusion of the fitting tube portion 21, so that the connectors 10 move in the left and right direction and in the up and down direction to be able to be fitted to the mating connectors 15. As a result, a change in distance of the mating connectors 15 may be absorbed so that the connectors 10 can be smoothly fitted to the mating connectors 15.

When the fitting of the connector 10 and the mating connector 15 is completed, the tub 17 of the mating terminal fitting may be inserted at a normal depth into the connecting portion 22 of the terminal fitting 14, so that the terminal fitting 14 is electrically connected to the mating terminal fitting. When the fitting of the connector 10 and the mating connector 15 is completed, the mating locking portion 18 may be disengaged from the lower side of the locking hole 30 of the locking arm 27, the stopper 43 may be pushed up to the mating locking portion 18, and the elastic locking portion 40 may be bent, so that the engaging of the stopper 43 and the locking body portion 29 may be released (see FIG. 12). As a result, the detecting member 12 may become movable to the detecting position.

The operating member 13 may move forward while bending the operating member connecting hinge 90 at a proper timing before the fitting of the connector 10 and the mating connector 15, to arrive at the upper side of the rear end portion of the detecting member 12. The two connectors 10 may be held side by side in the holder 11, and the respective detecting members 12 may be attached to both the connectors 10 as described above. The operating member 13 may be disposed to collectively cover the upper sides of the rear end portions of the two detecting members 12 disposed side by side on the left and right sides. In the present state, the operating member 13 may be pushed down. Each protruding portion 94 may be inserted into the window hole 47 of the corresponding detecting member 12 from above, both the stopping portions 93 may be inserted into the stopping grooves 49 on the rear end portion side of the corresponding detecting member 12 elastically, and the retaining protrusions 96 provided on both the elastic locking pieces 95 may elastically enter the stopping grooves 49 on the right and left external sides of the corresponding detecting member 12 (see FIG. 11). Thus, the operating member 13 may be connected to the detecting member 12 to become a substantially integrated state. At the present time, the projection 98 of the locking piece 97 may be positioned immediately behind the operating member locking portion 82.

Figure 13:
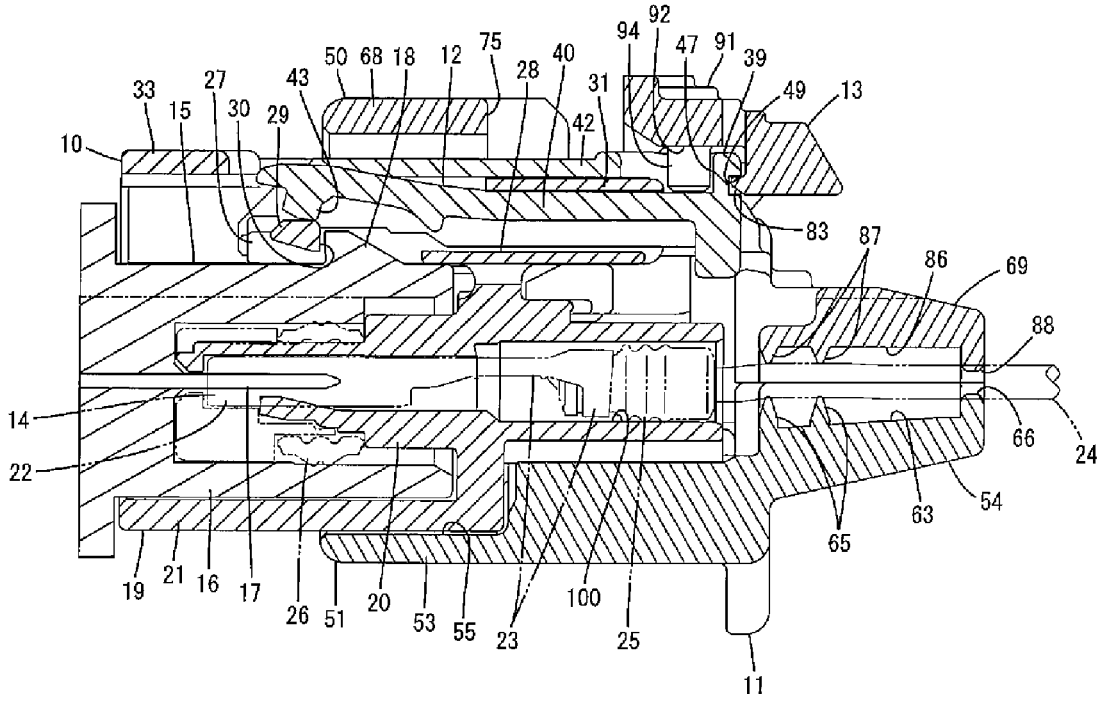
FIG. 13 is a side cross-sectional view for describing a process in which a detecting member moves toward a detecting position in the state of FIG. 12.

In the present state, the non-slip portion 91 of the operating member 13 may be pressed from behind. As such, both the detecting members 12 may be pressed by the operating member 13 to move toward the detecting position. In the process in which both the detecting members 12 move toward the detecting position, the stopper 43 may ride over the locking body portion 29 so that the bent state of the elastic locking portion 40 is maintained (see FIG. 13). Further, the projection 98 may ride over the operating member locking portion 82, and the locking piece 97 may be bent and deformed (see FIG. 15). In the process in which both the detecting members 12 move toward the detecting position, both the guide portions 41 may slide on both the rail portions 32 of the arm portion 28 to guide the movement of both the detecting members 12.

Figure 14:
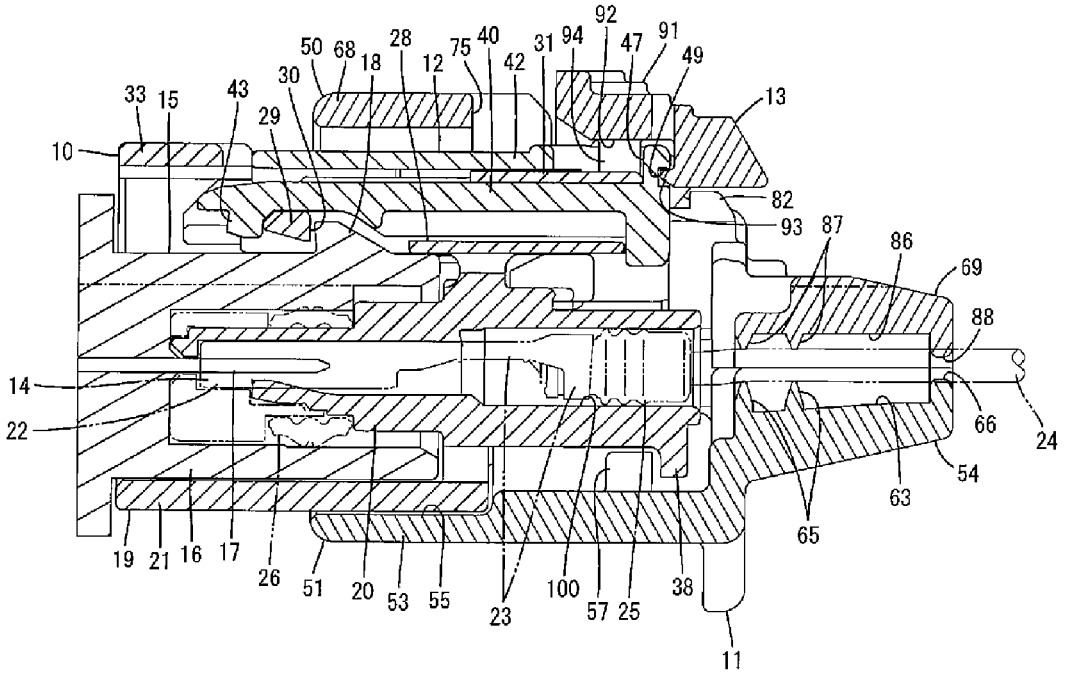
FIG. 14 is a side cross-sectional view showing the detecting member moved to the detecting position in the state of FIG. 13.

As such, when the operating member 13 is press-fitted, both the detecting members 12 may reach the detecting position. In the detecting position, the elastic locking portion 40 may be elastically returned, and the stopper 43 may be disposed to be engageable with the locking body portion 29 in the front direction (see FIG. 14). The front end portion of the cover portion 42 may be disposed to be contactable with the wall portion 33 from behind. As a result, both the detecting members 12 may be prevented from moving to the detecting position.

When the detecting member 12 reaches the detection position so that the front end portion of the cover portion 42 comes into contact with the rear portion of the wall portion 33, the operating member 13 may be prevented from further being press-fitted. As the detecting members 12 reach the detecting position, the operating member 13 may reach the press-fitting position. When the operating member 13 reaches the press-fitting position, the locking piece 97 may elastically return, and the projection 98 may collide against the collision receiving surface 83 of the sound generating portion 81 (see FIG. 16) so that sound is generated. The generated sound may resonate in the resonance space portion 84, and output in a state in which the volume is increased. It is possible to judge that the operating member 13 reaches the press-in position and both the detecting members 12 reach the detecting position by receiving the sound generated when the projection 98 hits the collision receiving surface 83. Both the detecting members 12 may reach the detecting position at the same timing.

When the operating member 13 reaches the press-in position, the projection 98 may be disposed to be engageable with the operating member locking portion 82 in the front direction. As a result, the movement of the operating member 13 in the backward direction in the press-in position may be restricted.

It may be necessary to separate the connector 10 and the mating connector 15 from each other due to maintenance or the like. When the connector 10 is detached from the mating connector 15, it may be first necessary to return the detecting member 12 to the standby position. In the various exemplary embodiments, when returning the detecting member 12 to the standby position, the non-slip portion 91 of the operation member 13 may be pressed from above. As such, the operating member 13 may be pushed down together with the rear end portions of the detecting members 12, so that the front end portion of the elastic locking portion 40 is pulled up and the engagement between the stopper 43 and the locking body portion 29 is released. In the present state, a returning force may be applied to the operating member 13 from behind. As such, the rear surface of the projection 98 in the shape of an inclined surface may ride over on the operating member locking portion 82 to release the engagement of the projection 98 and the operating member locking portion 82. When the operating member 13 is retracted, both the detecting members 12 may be retracted simultaneously with the operating member 13, and return to the standby position. Thereafter, the engaging of the locking arm 27 and the mating locking portion 18 may be released, so that the connector 10 is released from the mating connector 15.

As described above, according to the various exemplary embodiments, the following operational effects can be exhibited:

Two connectors 10 may be held side by side in the holder 11, and in the present state, both the connectors 10 may be collectively fitted to the corresponding mating connectors 15, respectively. Therefore, it is not necessary to perform the fitting operation for each connector 10, resulting in a reduction of workload. As a result, the workability in fitting the connectors can be improved.

The holder 11 may include the pair of halves 50 and 51 including the upper holder 50 and the lower holder 51. The two connectors 10 may be easily mounted on the holder 11 because the upper holder 50 and the lower holder 51 are coupled with the two connectors 10 in between.

When the holder 11 is in the separated state, since the two connectors 10 are held with the upper holder 50 in the holding state through the upper locking portion 76, it is possible to prevent displacement of the positions of both the connectors 10 with respect to the upper holder 50 when the upper holder 50 is coupled with the lower holder 51. As a result, the upper holder 50 and the lower holder 51 can be smoothly coupled.

Since the holder 11 includes the connector accommodating space 74 for individually accommodating the two connectors 10, and the two connectors 10 are accommodated in the connector accommodating space 74 to be movable in the left and right direction and the up and down direction, respectively, the connector 10 may be guided to a position to which it can be fitted to the mating connector 15 by moving in the left and right direction and the up and down direction in the connector accommodating space 74. As a result, the fitting operation of the connector 10 and the mating connector 15 can be performed smoothly.

Since the upper holder 50 and the lower holder 51 constituting both the halves 50 and 51 are connected to each other via the half connecting hinge 52, the number of parts of the holder 11 can be prevented from increasing.

Since the two connectors 10 are held side by side in the holder 11, the detecting members 12 individually attached to both the connectors 10 in the present state may be moved collectively to the detecting position by the operating member 13, it is not necessary to perform the operation of moving the detecting member 12 for each connector 10, and the workability in moving the detecting members 12 to the detecting position can be improved. It is also possible to collectively return both the detection members 12 to the standby position by pressing the operation member 13 when the detection member 12 is at the detection position, and the workability in moving the detecting member 12 to the standby position can be improved.

When the operating member 13 presses the detecting member 12, the stopping groove 49 and the stopping protrusion 93 provided on the opposed surfaces of the operating member 13 and the detecting member 12 may be fitted to each other so that the position of the operating member 13 is prevented from being displaced with respect to the detecting member 12. Therefore, the operability when the operating member 13 presses the detecting member 12 can be improved.

The holder 11 may include the sound generating portion 81, and a locking piece 97 which reaches the press-in position when the operating member 13 moves the detecting member 12 to the detecting position and hits the sound generating portion 81 to generate a sound. Therefore, it can be confirmed that the detecting member 12 is moved to the detecting position by recognizing the sound generated when the locking piece 97 hits the sound generation portion 81.

The locking piece 97 may be locked to the operating member locking portion 82 of the holder 11 so that the operating member 13 is restricted from moving in the returning direction from the press-in position. Therefore, the function of generating sound on the locking piece 97 and the function of restricting the return movement of the operating member 13 may be integrally provided. As a result, the configuration can be simplified as compared with the case where the two functions (the sound generating function and the return movement restricting function) are separately provided.

Since the operating member 13 is connected to the upper holder 50 via the operating member connecting hinge 90, as compared with the case where the operating member 13 and the upper holder 50 are separately provided, the number of parts may be reduced.

When the wire 24 led out to the outside from the holder 11 vibrates, since a portion of the wire in the holder 11 is inserted between the upper contact piece 87 and the lower contact piece 65, the vibrating force of the wire 24 may be prevented from being transmitted to the terminal fitting 14. As a result, it is possible to suppress sliding contact abrasion at the connection portion between the terminal fitting 14 and the mating terminal fitting, improving the connection reliability. In the various exemplary embodiments, since the vibrating force of the wire 24 is widely dispersed into the holder 11 and the two connectors 10 held by the holder 11, the vibrating force of the wire 24 may be hardly transmitted to the terminal fitting 14 so that the connection reliability can be further improved.

Finally, the upper contact piece 87 may be provided on the upper holder 50, and the lower contact piece 65 may be provided on the lower holder 51. Thus, each of the contact pieces 87 and 65 can be easily formed.

Another exemplary embodiment of the present invention will be briefly described below.

The holder may be configured to hold three or more connectors side by side. In the present case, the holder may be configured to have three or more connector accommodating space. In various exemplary embodiments:

Both the halves may be coupled (closed) and separated (opened) in the left and right direction.

The holder may have a structure in which both the halves are mutually separable, without having half connection hinges.

The holder may not have the operating member connecting hinge, and the operating member may be separated from the holder.

When the holder is in the separated state, the connector may be configured to be held in either the upper holder or the lower holder. For example, the lower holder may not have the lower locking portion, and the connector may not be engaged with the lower holder.

The connector may be allowed to move only in the lateral direction (the alignment direction of the connector) in the connector accommodating space of the holder.

The sound generating portion may be provided in the connector housing of the connector.

(The wire drawn out to the outside from the connector may be configured to contact only one of the upper contact piece and the lower contact piece to restrict the movement. In the present case, the other one of the upper contact piece and the lower contact piece may be omitted.

For convenience in explanation and accurate definition in the appended claims, the terms "upper", "lower", "internal", "outer", "up", "down", "upwards", "downwards", "front", "rear", "back", "inside", "outside", "inwardly", "outwardly", "internal", "external", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An electrical connector device comprising:

a plurality of first connectors;

a plurality of second connectors configured to be fitted to each of the first connectors;

a detecting member arranged movably to a standby position or a detecting position with respect to the plurality of second connectors and movable to the detecting position when the plurality of second connectors are fitted to the plurality of first connectors;

a holder configured to hold the plurality of second connectors in parallel, wherein each of the plurality of second connectors is collectively fitted to each of the plurality of first connectors, respectively; and an operation member configured of moving the detecting member individually disposed in the plurality of second connectors to the detecting position, wherein the holder includes a first half, a second half, a first hinge connecting the first half and the second half, and a second hinge connecting the operation member and the holder, wherein the first half and the second half are coupled to each other by pivoting with respect to the first hinge in a first direction, and wherein the operation member is coupled to the holder by pivoting with respect to the second hinge in a second direction intersecting the first direction.

2. The electrical connector device according to claim 1, wherein the first half and the second half are coupled to each other with the plurality of second connectors disposed between the first half and the second half.

3. The electrical connector device according to claim 1, wherein at least one of the first half and the second half is provided with a locking portion to which the second connectors are hooked.

4. The electrical connector device according to claim 1, wherein the holder further includes a connector accommodating space for respectively accommodating the second connectors, and wherein the second connectors are accommodated in the connector accommodating space in a state which the second connectors are allowed to move at least in an alignment direction thereof.

5. The electrical connector device according to claim 1, wherein the hinge is connected to a portion of the first half and a portion of the second half so that the first half and the second half are pivotal with respect to the hinge, and wherein the plurality of second connectors is disposed between the first half and the second half while the first half and the second half are connected to each other.

* * * * *